US011320164B2

(12) United States Patent
Roth

(10) Patent No.: US 11,320,164 B2
(45) Date of Patent: May 3, 2022

(54) CONTINUOUS MONITORING FOR EARLY FAILURE DETECTION IN CLIMATE CONTROL SYSTEMS

(71) Applicant: Roth Technologies, LLC, San Antonio, TX (US)

(72) Inventor: Ronald B. Roth, San Antonio, TX (US)

(73) Assignee: Roth Technologies, LLC, San Antonio, TX (US)

( * ) Notice: Subject to any disclaimer, the term of this patent is extended or adjusted under 35 U.S.C. 154(b) by 0 days.

(21) Appl. No.: 17/156,611

(22) Filed: Jan. 24, 2021

(65) Prior Publication Data

US 2021/0140664 A1 May 13, 2021

Related U.S. Application Data

(63) Continuation-in-part of application No. 16/672,401, filed on Nov. 1, 2019, now Pat. No. 11,248,817.

(51) Int. Cl.

| | |
|---|---|
| ***F24F 11/38*** | (2018.01) |
| ***F24F 11/63*** | (2018.01) |
| *F24F 110/10* | (2018.01) |
| *F24F 110/40* | (2018.01) |
| *F24F 140/20* | (2018.01) |

(52) U.S. Cl.

CPC ..... *F24F 11/38* (2018.01); *F24F 11/63* (2018.01); *F24F 2110/10* (2018.01); *F24F 2110/40* (2018.01); *F24F 2140/20* (2018.01)

(58) Field of Classification Search

CPC .. F24F 11/38; F24F 11/64; F24F 11/65; F24F 2140/60; F24F 2110/10; F24F 2140/50; F24F 2110/12; G05B 17/02

See application file for complete search history.

(56) References Cited

U.S. PATENT DOCUMENTS

| | | | | |
|---|---|---|---|---|
| 4,574,871 | A * | 3/1986 | Parkinson | G05D 23/1917 165/11.1 |
| 7,966,152 | B2 | 6/2011 | Stluka et al. | |
| 9,256,702 | B2 | 2/2016 | ElBsat et al. | |
| 10,055,114 | B2 | 8/2018 | Shah et al. | |
| 2002/0105429 | A1 | 8/2002 | Donner et al. | |
| 2005/0273280 | A1 | 12/2005 | Cox | |
| 2009/0072846 | A1 | 3/2009 | Fjerstad | |
| 2011/0010509 | A1 | 1/2011 | Flores et al. | |

(Continued)

OTHER PUBLICATIONS

Rosenmai, Peter. Using the Median Absolute Deviation to Find Outliers. Eureka Statistics. <https://eurekastatistics.com>. Accessed Apr. 17, 2021.

(Continued)

*Primary Examiner* — Santosh R Poudel

(57) ABSTRACT

Computer program products, devices, systems, and operations for early detection of poor performance and failure of a climate control system. The invention provides operations for computing an actual run time percentage (ART) from operational data of the climate control system, and operations for computing an estimated run time percentage (ERT) of the climate control system from temperature data of an uncontrolled climate. The invention also provides operations for issuing one or more alerts if the ART deviates from the ERT or a range thereof.

20 Claims, 30 Drawing Sheets

(56) References Cited

U.S. PATENT DOCUMENTS

| | | | | |
|---|---|---|---|---|
| 2011/0125452 | A1 | 5/2011 | Bash et al. | |
| 2011/0131030 | A1 | 6/2011 | McCoy et al. | |
| 2013/0189702 | A1 | 7/2013 | Altmann et al. | |
| 2014/0236501 | A1 | 8/2014 | Mao et al. | |
| 2014/0266755 | A1* | 9/2014 | Arensmeier | F24F 11/62 340/679 |
| 2014/0371917 | A1* | 12/2014 | Rite | F24F 11/30 700/276 |
| 2015/0127170 | A1* | 5/2015 | Quam | G06Q 10/20 700/276 |
| 2015/0323394 | A1* | 11/2015 | Alsaleem | G01K 17/20 702/130 |
| 2017/0060656 | A1 | 3/2017 | Bhattacharya et al. | |
| 2017/0336091 | A1 | 11/2017 | Arensmeier et al. | |
| 2017/0361259 | A1* | 12/2017 | Fox | B01D 46/0086 |
| 2018/0195751 | A1* | 7/2018 | Bruck | F24F 11/46 |
| 2019/0234638 | A1 | 8/2019 | Song et al. | |
| 2019/0264936 | A1* | 8/2019 | Bailey | G05B 15/02 |
| 2020/0368661 | A1* | 11/2020 | Fox | F24F 11/00 |

OTHER PUBLICATIONS

"Measures of Dispersion", 2020, UC San Diego "http://www.cogsci.ucsd.edu/~nunez/COGS14A_F12/W4.pdf" (Year 2020).

"Sasha Draganov, Detection of outliers in navigation sensor measurements, 2016 IEEE/ION Position, Location and Navigation Symposium (PLANS), Savannah, GA, 2016, pp. 1001-1007, doi: 10.1109/PLANS.2016.747980" (Year 2016).

* cited by examiner

Measure and record (every minute) when HVAC is ON and OFF

| Time | Blower Fan Current (normalized) | HVAC Stage |
|---|---|---|
| 0 | 10 | OFF |
| 1 | 10 | OFF |
| 2 | 10 | OFF |
| 3 | 10 | OFF |
| 4 | 10 | OFF |
| 5 | 10 | OFF |
| 6 | 11 | OFF |
| 7 | 11 | OFF |
| 8 | 11 | OFF |
| 9 | 10 | OFF |
| 10 | 10 | OFF |
| 11 | 10 | OFF |
| 12 | 10 | OFF |
| 13 | 10 | OFF |
| 14 | 10 | OFF |
| 15 | 148 | ON |
| 16 | 148 | ON |
| 17 | 147 | ON |
| 18 | 148 | ON |
| 19 | 147 | ON |
| 20 | 147 | ON |
| 21 | 148 | ON |
| 22 | 15 | OFF |
| 23 | 11 | OFF |
| 24 | 11 | OFF |
| 25 | 11 | OFF |

62

Home or Business Estimated Run Time Calibration Table (example data)

From FIG. 12A

To FIG. 12C

| CDD to HVAC Run Time Cal Table | | HVAC Run Time (%) | Number of Updates |
|---|---|---|---|
| CDD Value | 0 | 0.000 | 0 |
| | 2 | 0.000 | 0 |
| | 4 | 0.000 | 0 |
| | 6 | 2.993 | 25 |
| | 8 | 8.337 | 28 |
| | ... | | |
| | ... | | |
| | CDD(i) | RT(i) | N |
| | CDD(i+1) | RT(i+1) | M |
| | ... | | |
| | ... | | |
| | 44 | 43.656 | 22 |
| | 46 | 44.357 | 22 |
| | 48 | 47.460 | 6 |
| | 50 | 53.970 | 6 |

CDD = SUM(CDDi)

FIG. 12B

| CDD | HVAC Run Time % (original) | HVAC Run Time % (updated) | Delta |
|---|---|---|---|
| 0 | 0.000 | 0.000 | 0.000 |
| 2 | 0.000 | 0.000 | 0.000 |
| 4 | 0.000 | 0.000 | 0.000 |
| 6 | 2.822 | 2.822 | 0.000 |
| 8 | 9.069 | 9.069 | 0.000 |
| 10 | 15.397 | 15.455 | -0.058 |
| 12 | 19.465 | 19.962 | -0.497 |
| 14 | 27.131 | 27.131 | 0.000 |
| 16 | 26.501 | 26.501 | 0.000 |
| 18 | 33.038 | 33.038 | 0.000 |
| 20 | 39.575 | 39.575 | 0.000 |
| 22 | 42.087 | 42.087 | 0.000 |
| 24 | 43.665 | 43.665 | 0.000 |
| 26 | 47.387 | 47.387 | 0.000 |
| 28 | 59.980 | 59.980 | 0.000 |
| 30 | 59.980 | 59.980 | 0.000 |
| 32 | 59.980 | 59.980 | 0.000 |
| 34 | 59.980 | 59.980 | 0.000 |
| 36 | 59.980 | 59.980 | 0.000 |
| 38 | 59.980 | 59.980 | 0.000 |
| 40 | 59.980 | 59.980 | 0.000 |
| 42 | 59.980 | 59.980 | 0.000 |
| 44 | 59.980 | 59.980 | 0.000 |
| 46 | 59.980 | 59.980 | 0.000 |
| 48 | 59.980 | 59.980 | 0.000 |
| 50 | 59.980 | 59.980 | 0.000 |

FIG. 13C

| CDD | Sunday | | Monday | | Tuesday | |
|---|---|---|---|---|---|---|
| | HVAC Run Time% | Number of Updates | HVAC Run Time% | Number of Updates | HVAC Run Time% | Number of Updates |
| 0 | 0.000 | 0 | 0.000 | 0 | 0.000 | 0 |
| 2 | 0.000 | 0 | 0.000 | 0 | 0.000 | 0 |
| 4 | 0.000 | 0 | 0.000 | 0 | 0.000 | 0 |
| 6 | 5.100 | 25 | 4.100 | 34 | 5.100 | 37 |
| 8 | 9.069 | 28 | 7.069 | 1 | 5.069 | 13 |
| 10 | 15.397 | 35 | 14.397 | 2 | 13.397 | 39 |
| 12 | 19.465 | 39 | 18.465 | 33 | 17.465 | 20 |
| 14 | 27.131 | 11 | 27.131 | 37 | 27.131 | 4 |
| 16 | 26.501 | 1 | 24.501 | 46 | 23.501 | 33 |
| 18 | 33.088 | 41 | 33.038 | 45 | 33.038 | 4 |
| 20 | 39.575 | 45 | 38.575 | 11 | 36.575 | 37 |
| 22 | 42.087 | 23 | 41.087 | 6 | 41.087 | 27 |
| 24 | 43.665 | 35 | 43.665 | 27 | 41.665 | 4 |
| 26 | 47.387 | 6 | 47.387 | 3 | 47.387 | 33 |
| 28 | 59.980 | 24 | 59.980 | 46 | 59.980 | 38 |
| 30 | 59.980 | 46 | 59.980 | 50 | 59.980 | 13 |
| 32 | 59.980 | 7 | 57.980 | 36 | 57.980 | 47 |
| 34 | 59.980 | 44 | 58.980 | 12 | 58.980 | 34 |
| 36 | 59.980 | 16 | 59.980 | 27 | 59.980 | 13 |
| 38 | 59.980 | 14 | 59.980 | 33 | 58.980 | 35 |
| 40 | 59.980 | 29 | 57.980 | 50 | 56.980 | 44 |
| 42 | 59.980 | 45 | 57.980 | 33 | 57.980 | 35 |
| 44 | 59.980 | 8 | 59.980 | 42 | 58.980 | 35 |
| 46 | 59.980 | 23 | 58.980 | 31 | 57.980 | 29 |
| 48 | 59.980 | 2 | 59.980 | 21 | 59.980 | 48 |
| 50 | 59.980 | 1 | 59.980 | 18 | 57.980 | 47 |

FIG. 15A

| CDD | Wednesday | | Thursday | | Friday | | Saturday | |
|---|---|---|---|---|---|---|---|---|
| | HVAC Run Time% | Number of Updates | HVAC Run Time% | Number of Updates | HVAC Run Time% | Number of Updates | HVAC Run Time% | Number of Updates |
| 0 | 0.000 | 0 | 0.000 | 0 | 0.000 | 0 | 0.000 | 0 |
| 2 | 0.000 | 0 | 0.000 | 0 | 0.000 | 0 | 0.000 | 0 |
| 4 | 0.000 | 0 | 0.000 | 0 | 0.000 | 0 | 0.000 | 0 |
| 6 | 4.100 | 22 | 3.100 | 23 | 0.000 | 9 | 5.100 | 17 |
| 8 | 3.069 | 30 | 1.069 | 35 | -0.931 | 34 | -1.931 | 37 |
| 10 | 13.397 | 18 | 11.397 | 31 | 10.397 | 35 | 9.397 | 9 |
| 12 | 15.465 | 32 | 15.465 | 30 | 13.465 | 27 | 13.465 | 14 |
| 14 | 25.131 | 30 | 23.131 | 20 | 22.131 | 26 | 21.131 | 7 |
| 16 | 21.501 | 29 | 20.501 | 28 | 18.501 | 49 | 18.501 | 47 |
| 18 | 33.088 | 27 | 31.038 | 42 | 29.038 | 8 | 28.038 | 2 |
| 20 | 55.575 | 27 | 34.575 | 7 | 34.575 | 14 | 32.575 | 25 |
| 22 | 41.087 | 39 | 40.087 | 50 | 40.087 | 29 | 45.387 | 9 |
| 24 | 40.665 | 17 | 38.665 | 29 | 38.665 | 47 | 38.665 | 40 |
| 26 | 47.387 | 45 | 47.387 | 37 | 46.387 | 17 | 45.387 | 13 |
| 28 | 57.980 | 15 | 55.980 | 6 | 55.980 | 11 | 55.980 | 50 |
| 30 | 57.980 | 25 | 55.980 | 6 | 53.980 | 7 | 53.980 | 43 |
| 32 | 57.980 | 1 | 57.980 | 11 | 56.980 | 4 | 54.980 | 48 |
| 34 | 57.980 | 45 | 56.980 | 6 | 56.980 | 10 | 56.980 | 7 |
| 36 | 58.980 | 17 | 57.980 | 45 | 56.980 | 20 | 55.980 | 22 |
| 38 | 58.980 | 2 | 57.980 | 26 | 57.980 | 17 | 55.980 | 26 |
| 40 | 56.980 | 33 | 56.980 | 31 | 54.980 | 6 | 54.980 | 19 |
| 42 | 55.980 | 15 | 53.980 | 19 | 53.980 | 28 | 51.980 | 6 |
| 44 | 56.980 | 42 | 53.980 | 55 | 54.980 | 30 | 52.980 | 24 |
| 46 | 57.980 | 32 | 56.980 | 48 | 55.980 | 26 | 55.980 | 28 |
| 48 | 59.980 | 33 | 59.980 | 15 | 59.980 | 35 | 58.980 | 46 |
| 50 | 55.980 | 19 | 55.980 | 43 | 53.980 | 1 | 52.980 | 26 |

FIG. 15B

| | Military Time | | | | | | | | | | | | |
|---|---|---|---|---|---|---|---|---|---|---|---|---|---|
| Box Temp | 0:00 | 1:00 | 2:00 | 3:00 | 4:00 | 5:00 | 6:00 | 7:00 | 8:00 | 9:00 | 10:00 | 11:00 | 12:00 |
| 60 | 0.00 | 0.00 | 0.00 | 0.00 | 0.00 | 0.00 | 0.00 | 0.00 | 0.00 | 0.00 | 0.00 | 0.00 | 0.00 |
| 65 | 0.22 | 2.45 | 0.88 | 0.09 | 0.37 | 1.53 | 2.14 | 1. | 0.05 | 0.00 | 0.00 | 0.00 | 0.00 |
| 70 | 1.07 | 1.97 | 1.32 | 3.14 | 2.45 | 8.54 | 7.36 | 8.19 | 1.36 | 16.10 | 0.00 | 0.00 | 0.00 |
| 75 | 7.92 | 8.59 | 3.36 | 5.75 | 9.47 | 16.16 | 12.29 | 13.63 | 5.18 | 17.31 | 0.32 | 0.00 | 2.73 |
| 80 | 11.78 | 18.17 | 9.27 | 20.53 | 15.69 | 16.78 | 19.74 | 23.16 | 18.40 | 12.79 | 0.86 | 0.00 | 13.13 |
| 85 | 33.72 | 26.43 | 17.86 | 20.53 | 15.69 | 16.78 | 19.74 | 23.16 | 18.40 | 12.79 | 2.67 | 0.00 | 18.12 |
| 90 | 33.72 | 26.43 | 17.86 | 20.53 | 15.69 | 16.78 | 19.74 | 23.16 | 18.40 | 12.79 | 15.09 | 2.84 | 21.36 |
| 95 | 33.72 | 26.43 | 17.86 | 20.53 | 15.69 | 16.78 | 19.74 | 23.16 | 18.40 | 12.79 | 15.09 | 6.00 | 24.98 |
| 100 | 33.72 | 26.43 | 17.86 | 20.53 | 15.69 | 16.78 | 19.74 | 23.16 | 18.40 | 12.79 | 15.09 | 15.58 | 28.13 |
| 105 | 33.72 | 26.43 | 17.86 | 20.53 | 15.69 | 16.78 | 19.74 | 23.16 | 18.40 | 12.79 | 15.09 | 15.58 | 31.14 |
| 110 | 33.72 | 26.43 | 17.86 | 20.53 | 15.69 | 16.78 | 19.74 | 23.16 | 18.40 | 12.79 | 15.09 | 15.58 | 34.19 |
| 115 | 33.72 | 26.43 | 17.86 | 20.53 | 15.69 | 16.78 | 19.74 | 23.16 | 18.40 | 12.79 | 15.09 | 15.58 | 32.48 |
| 120 | 33.72 | 26.43 | 17.86 | 20.53 | 15.69 | 16.78 | 19.74 | 23.16 | 18.40 | 12.79 | 15.09 | 15.58 | 32.48 |
| 125 | 33.72 | 26.43 | 17.86 | 20.53 | 15.69 | 16.78 | 19.74 | 23.16 | 18.40 | 12.79 | 15.09 | 15.58 | 32.48 |
| 130 | 33.72 | 26.43 | 17.86 | 20.53 | 15.69 | 16.78 | 19.74 | 23.16 | 18.40 | 12.79 | 15.09 | 15.58 | 32.48 |
| 135 | 33.72 | 26.43 | 17.86 | 20.53 | 15.69 | 16.78 | 19.74 | 23.16 | 18.40 | 12.79 | 15.09 | 15.58 | 32.48 |
| 140 | 33.72 | 26.43 | 17.86 | 20.53 | 15.69 | 16.78 | 19.74 | 23.16 | 18.40 | 12.79 | 15.09 | 15.58 | 32.48 |

FIG. 15C

| Box Temp | 13:00 | 14:00 | 15:00 | 16:00 | 17:00 | 18:00 | 19:00 | 20:00 | 21:00 | 22:00 | 23:00 |
|---|---|---|---|---|---|---|---|---|---|---|---|
| 60 | 0.00 | 0.00 | 0.00 | 0.00 | 0.00 | 0.00 | 0.00 | 0.00 | 0.00 | 0.00 | 0.00 |
| 65 | 0.00 | 0.00 | 0.00 | 0.00 | 0.00 | 0.00 | 0.00 | 0.00 | 0.00 | 0.00 | 0.72 |
| 70 | 0.00 | 0.00 | 0.00 | 0.00 | 0.00 | 0.00 | 0.00 | 1.75 | 0.00 | 16.10 | 15.74 |
| 75 | 0.00 | 0.00 | 0.00 | 0.00 | 0.00 | 0.00 | 0.00 | 23.75 | 7.85 | 17.31 | 16.85 |
| 80 | 6.34 | 0.00 | 0.00 | 0.00 | 0.00 | 0.00 | 0.00 | 28.60 | 8.58 | 18.52 | 37.34 |
| 85 | 15.29 | 0.00 | 0.00 | 0.00 | 1.98 | 4.06 | 17.14 | 31.53 | 15.36 | 34.53 | 37.82 |
| 90 | 21.64 | 0.00 | 2.98 | 32.09 | 9.19 | 20.10 | 30.86 | 35.31 | 30.57 | 38.01 | 37.82 |
| 95 | 30.23 | 5.42 | 11.76 | 32.10 | 16.12 | 22.98 | 47.84 | 55.35 | 30.57 | 38.01 | 37.82 |
| 100 | 41.19 | 36.72 | 20.71 | 32.11 | 23.04 | 31.28 | 39.39 | 52.58 | 30.57 | 38.01 | 37.82 |
| 105 | 41.19 | 36.72 | 39.63 | 32.44 | 23.77 | 47.78 | 48.21 | 52.58 | 30.57 | 38.01 | 37.82 |
| 110 | 41.19 | 36.72 | 33.43 | 37.23 | 31.88 | 56.38 | 48.21 | 52.58 | 30.57 | 38.01 | 37.82 |
| 115 | 41.19 | 36.72 | 37.65 | 37.23 | 39.99 | 56.38 | 48.21 | 52.58 | 30.57 | 38.01 | 37.82 |
| 120 | 41.19 | 36.72 | 37.65 | 43.84 | 44.77 | 56.38 | 48.21 | 52.58 | 30.57 | 38.01 | 37.82 |
| 125 | 41.19 | 36.72 | 37.65 | 43.84 | 44.77 | 56.38 | 48.21 | 52.58 | 30.57 | 38.01 | 37.82 |
| 130 | 41.19 | 36.72 | 37.65 | 43.84 | 44.77 | 56.38 | 48.21 | 52.58 | 30.57 | 38.01 | 37.82 |
| 135 | 41.19 | 36.72 | 37.65 | 43.84 | 44.77 | 56.38 | 48.21 | 52.58 | 30.57 | 38.01 | 37.82 |
| 140 | 41.19 | 36.72 | 37.65 | 43.84 | 44.77 | 56.38 | 48.21 | 52.58 | 30.57 | 38.01 | 37.82 |

FIG. 15D

| CDD | HVAC Run Time % Before | HVAC Run Time % Adjusted |
|---|---|---|
| 0 | 0.000 | 0.000 |
| 2 | 0.000 | 0.000 |
| 4 | 0.000 | 0.000 |
| 6 | 2.822 | 2.822 |
| 8 | 9.069 | 9.069 |
| 10 | 15.397 | 15.397 |
| 12 | 19.465 | 19.465 |
| 14 | 27.131 | 27.131 |
| 16 | 26.501 | 30.085 |
| 18 | 33.038 | 33.038 |
| 20 | 39.575 | 39.575 |
| 22 | 42.087 | 42.087 |
| 24 | 40.124 | 44.737 |
| 26 | 47.387 | 47.387 |
| 28 | 59.980 | 59.980 |
| 30 | 59.980 | 59.980 |
| 32 | 59.980 | 59.980 |
| 34 | 59.980 | 59.980 |
| 36 | 59.980 | 59.980 |
| 38 | 59.980 | 59.980 |
| 40 | 59.980 | 59.980 |
| 42 | 59.980 | 59.980 |
| 44 | 59.980 | 59.980 |
| 46 | 59.980 | 59.980 |
| 48 | 59.980 | 59.980 |
| 50 | 59.980 | 59.980 |

FIG. 16A

| CDD | HVAC Run Time % Before | HVAC Run Time % Adjusted |
|---|---|---|
| 0 | 0.000 | 0.000 |
| 2 | 0.000 | 0.000 |
| 4 | 0.000 | 0.000 |
| 6 | 2.822 | 2.822 |
| 8 | 9.069 | 9.069 |
| 10 | 15.397 | 15.397 |
| 12 | 19.465 | 19.465 |
| 14 | 27.131 | 27.131 |
| 16 | 26.501 | 26.501 |
| 18 | 33.038 | 33.038 |
| 20 | 39.575 | 39.575 |
| 22 | 42.087 | 42.087 |
| 24 | 43.665 | 43.665 |
| 26 | 47.387 | 47.387 |
| 28 | 59.980 | 59.980 |
| 30 | 58.481 | 59.980 |
| 32 | 0.000 | 59.980 |
| 34 | 0.000 | 59.980 |
| 36 | 0.000 | 59.980 |
| 38 | 0.000 | 59.980 |
| 40 | 0.000 | 59.980 |
| 42 | 0.000 | 59.980 |
| 44 | 0.000 | 59.980 |
| 46 | 0.000 | 59.980 |
| 48 | 0.000 | 59.980 |
| 50 | 0.000 | 59.980 |

FIG. 16B

CONTINUOUS MONITORING FOR EARLY FAILURE DETECTION IN CLIMATE CONTROL SYSTEMS

CROSS-REFERENCE TO RELATED APPLICATIONS

This application claims the benefit of and is a continuation-in-part of U.S. patent application Ser. No. 16/672,401, filed Nov. 1, 2019, entitled "CONTINUOUS MONITORING SYSTEM FOR EARLY FAILURE DETECTION IN HVAC SYSTEMS". The above-identified application is hereby incorporated herein by reference in its entirety.

FIELD OF THE INVENTION

Embodiments of the present invention relate to computer program products, devices, and systems for early detection of poor performance and failure of a climate control system, such as a heating, ventilation, and air conditioning (HVAC) system.

BACKGROUND OF THE INVENTION

HVAC systems improve environmental comfort and air quality within an indoor space. HVAC systems provide heat to the indoor space when the outside weather is cold and provide cool air to the indoor space when the outside weather is warm. Because HVAC systems are heavily relied upon for maintaining a safe and acceptable environment within the indoor space, their failure can cause a variety of undesired effects for individuals within the indoor space, such as poor health, dehydration, or even death. Accordingly, HVAC systems must remain consistently functional and have limited down time.

HVAC systems may fail due to a variety of reasons, including freezing of a portion of the HVAC system, electrical failure, refrigerant leak, dirt buildup in a filter of the HVAC system, and the like. Because failure of the HVAC system often occurs unexpectedly, there may be significant delay between failure of the system and correction of the issue by a specialist trained to diagnose the issue and repair or replace the system. During times or seasons of peak usage, such down time while waiting for the specialist may cause health problems or other problems for individuals within the indoor space.

In addition to risks associated with HVAC down time, degraded HVAC systems utilize more resources (e.g., electrical power) compared to properly functioning HVAC systems. A consequence of a single HVAC system consuming more power may be increased cost to the owner of the HVAC system. A consequence of multiple HVAC systems consuming more power may be increased strain to the electrical power grid, which may cause brownouts, blackouts, and other problems, which may in turn may cause complete failure of multiple HVAC systems.

A degree day (DD) may be a heating degree day (HDD), which is a measurement designed to quantify the demand for energy needed to heat the indoor space, or a cooling degree day (CDD), which is a measurement designed to quantify the demand for energy needed to cool the indoor space. The energy requirements for heating or cooling the indoor space are proportional to the HDD or CDD, respectively. Currently, HDD and CDD provide simple metrics for quantifying the amount of heating that indoor spaces in a particular location need over a long period of time, such as a particular month or a particular year.

However, calculations using HDD or CDD come with several problems. Heating and cooling requirements are not linear with temperature, and heavily insulated buildings have a lower balance point which means that these buildings may have a lower demand for heating or cooling compared to lightly insulated buildings. The amount of heating or cooling required depends on many factors in addition to outdoor temperature, including but not limited to how well insulated the indoor space is, the amount of solar radiation reaching the indoor space, the number of electrical appliances running within the indoor space (which raise the indoor temperature), the amount of wind outside, the setpoint temperature selected by occupants within the indoor space, and other factors which may affect the thermal response of the building.

Accordingly, there is a need for an ability to quantify the amount of energy needed to heat or cool an indoor space for shorter periods, such as a single day, which may be used to evaluate HVAC system operational soundness. In addition, there is a need for a novel algorithm for computing daily energy requirements that accounts for differences in building designs, shade, insulation, location, and other differences. The present invention addresses these unmet needs.

SUMMARY OF THE INVENTION

The present invention, applicable to both heating (furnace) and cooling (air conditioning) modes of HVAC systems, is advantageous because each installation of the present invention carries a unique, evolving data set that is specific to that installation. As a result, the exact criteria defining suboptimal performance or early failure of the HVAC system may differ among different installations. Because multiple factors may impact HVAC system use and performance, it may be difficult to manually adjust the data set according to these factors in each specific environment or installation. Accordingly, the present invention utilizes real-world usage data from a previous observation period, such as the previous day, to forecast usage data for a subsequent observation period, such as the present day. If the estimated run time percentage (ERT) differs enough from the actual run time percentage (ART) observed, then an alert may be issued by a device or a system of the present invention. Individuals may become aware of suboptimal operation or early failure of the HVAC system before wasting energy resources on the HVAC system and before complete failure of the HVAC system, thereby ensuring continuous operation of the HVAC system.

In one aspect, the present invention provides a computer program product, comprising a non-transitory computer readable storage medium having instructions encoded thereon that, when executed by a processor, cause the processor to perform operations comprising: receiving operational data of a climate control system of a controlled climate; computing an actual run time percentage (ART) of the climate control system from the operational data; receiving temperature data of an uncontrolled climate; computing an estimated run time percentage (ERT) of the climate control system from the temperature data; and issuing an alert if the ART deviates from the ERT or a range thereof. In embodiments, the computer program product may comprise a device which comprises the storage medium or may comprise a system which comprises such a device.

In embodiments, the operational data is received from a monitoring system that monitors a parameter of the climate control system. Exemplary parameters that may be monitored include, but are not necessarily limited to, an electrical current of the climate control system (e.g., at a thermostat or at a blower fan), a pressure differential across the climate control system, and a temperature differential across a heat exchanger of the climate control system. Any suitable intrusive or non-intrusive monitoring of the parameter of the climate control system may be utilized for determining actual run time percentage (ART) of the climate control system.

In embodiments, ART is computed by dividing an actual run time within an observation period by a length of the observation period to produce a ratio and expressing the ratio as a percentage. In embodiments, the temperature data of the uncontrolled climate originates from a measurement of a temperature sensor positioned external to the controlled climate (e.g., from a thermometer positioned outside a building, within an attic or upper enclosure of the building, or outside but distal to the building) during a previous observation period (e.g., the previous day). In embodiments, the temperature data may be obtained from a third-party weather monitoring service or system.

In embodiments, a plurality of degree day (DD) values may be computed using one or more base temperatures (BT) and a plurality of temperatures of the temperature data of the uncontrolled climate from the previous observation period. The plurality of DD values (e.g., 24 one-hour DD values) may be summed to produce an input DD sum value, which is representative of demand for heating or cooling during the previous observation period (e.g., for the previous day). The input DD sum value may then be compared to a plurality of DD sum values stored within a data structure, such as a database comprising a calibration table. By linearly interpolating a first DD sum value, a first ART value, a second DD sum value, and a second ART value to produce a linear slope formula, the input DD sum value may be used with the linear slope formula to compute the estimated run time (ERT) (e.g., for the present day). In embodiments, a range may be computed for ERT, and if the ART falls outside the range of the ERT, the alert is issued.

In embodiments, the operations further comprise creating or updating a data structure comprising the calibration table, which may be performed regularly (e.g., daily). In embodiments, the calibration table comprises: a first column comprising a plurality of degree day (DD) sum values; a second column comprising a plurality of ART values; and a third column comprising a plurality of update number values, such that if an ART value of the second column is updated, a corresponding update number value of the third column is incremented. The calibration table, which contains data that is specific to an HVAC installation at a particular location, may be critical for maintaining accuracy of the ERT calculation. Accordingly, in embodiments, the operations further comprise updating the calibration table by computing an error value by subtracting the ERT from the ART and computing an adjusted error value by multiplying the error value by an adaptive gain value. The adaptive gain value may critically impact how the calibration table is updated, and specific values for the adaptive gain value are recommended herein. After the adjusted error value is computed, new run time (ART) values are computed to replace old run time (ART) values in the calibration table. In embodiments, the new ART values may be computed utilizing one or more operations such as linear interpolation.

One object of the present invention is to provide early detection of issues with HVAC systems, such as pending failure and suboptimal operation, before users or service specialists typically become aware of such issues through independent observation. The present invention provides novel and useful algorithms, computer program products, devices, and systems which enable early detection of suboptimal operation of HVAC systems. The present invention enables the prevention of complete failure of the HVAC system and the problems associated with failure by notifying one or more individuals of issues with the HVAC system to facilitate early specialist intervention.

Another object of the present invention is to provide for continuous remote monitoring of the HVAC system. With a plurality of sensors, including one or more temperature sensors, one or more water probes, and one or more current sensors, continuous remote monitoring of the HVAC system, e.g., by an occupant of the building, a remote service technician, or another individual or entity, becomes feasible. Information relating to operation of the HVAC system may be received and maintained by a system of the present invention and may be used to provide alerts in the event of malfunction of the HVAC system, as well as to gather operational information about the HVAC system or related HVAC systems installed at a particular location as well as other locations.

Another object of the present invention is to provide computer program products, devices, and systems which are easily implemented, and which are time-effective and cost-effective. Installation of a device or system of the present invention may be performed by the trained technician in under ten minutes, and the HVAC system may be operational while the invention is installed. Through use of the present invention, individuals, businesses, and property managers benefit from lower repair costs and lower energy bills.

Another object of the present invention is to provide computer program products, devices, and systems which may readily be manufactured and utilized using available expertise and resources.

Other objects, features and advantages of the present invention will become apparent from the following detailed description taken in conjunction with the accompanying drawings.

BRIEF DESCRIPTION OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

FIG. 12B depicts a flow chart of a portion of an operation of the present invention which computes estimated run time percentage (ERT) from an input DD sum value.

FIG. 13C depicts an exemplary update to a calibration table of a data structure of the present invention which includes original data, updated data, and the difference therebetween.

FIG. 15A depicts an exemplary calibration table of a data structure of the present invention, which is divided into days of the week.

FIG. 15B depicts the exemplary calibration table, which is divided into days of the week.

FIG. 15C depicts an exemplary calibration table of a data structure of the present invention, which is divided into hours of the day.

FIG. 15D depicts the exemplary calibration table, which is divided into hours of the day.

FIG. 16A depicts an exemplary calibration table with columns showing ART values before and after an adjustment to increase a local minimum value to an average of two or more adjacent ART values.

FIG. 16B depicts an exemplary calibration table with columns showing ART values before and after an adjustment to assign a maximum ART value to a plurality of higher input DD sum values.

DETAILED DESCRIPTION OF THE INVENTION

Figure 1:
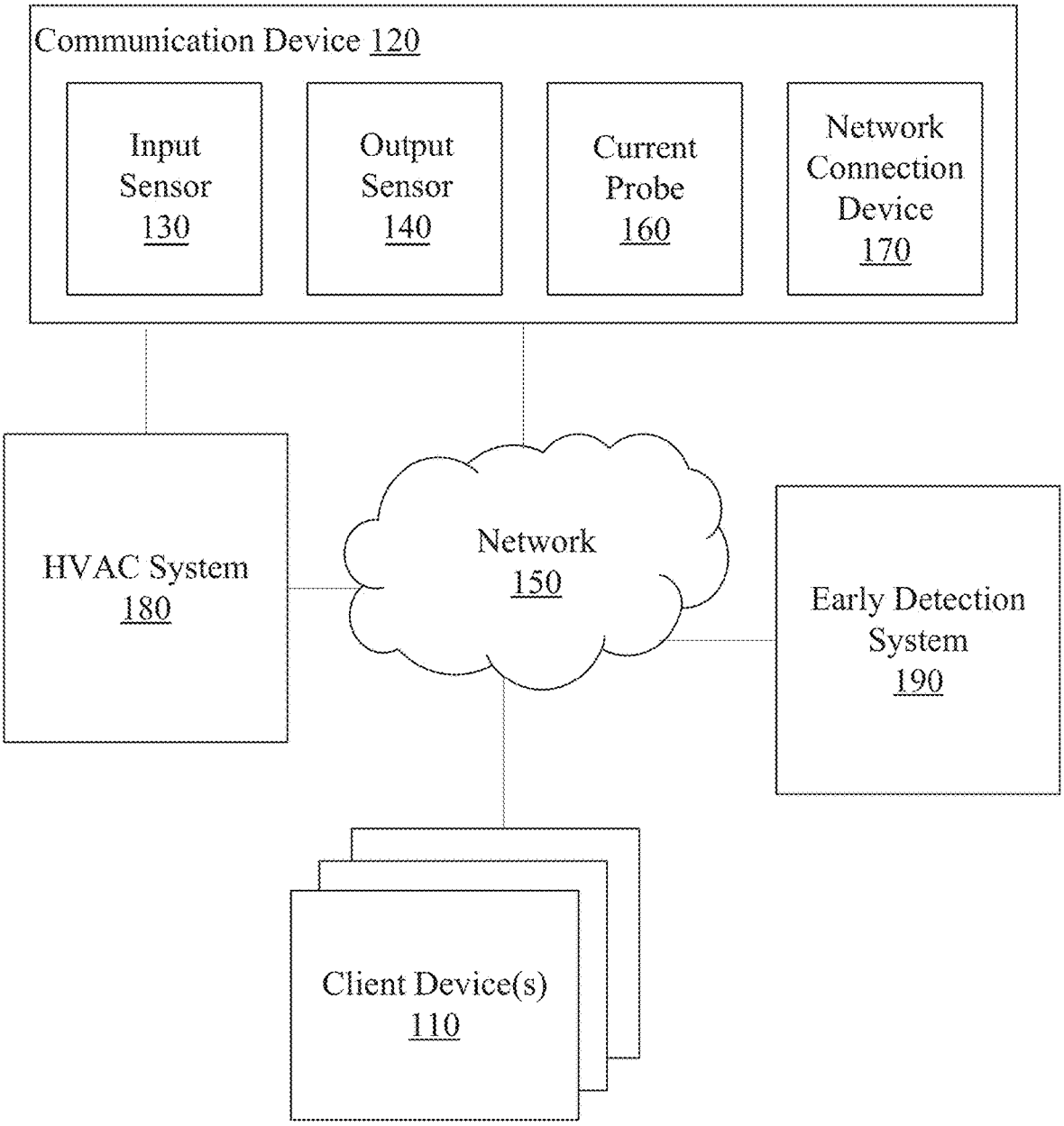
FIG. 1 depicts a diagram of elements of an exemplary continuous monitoring system for early failure detection in HVAC systems.

Reference is made herein to the attached drawings. Like reference numerals are used throughout the drawings to depict like or similar elements of the invention. The figures are intended for representative purposes only and should not be considered limiting in any respect.

Referring now to FIG. 1, there is depicted a diagram of elements of an exemplary continuous monitoring system for early failure detection in HVAC systems. In the shown embodiment, the continuous monitoring system comprises a communication device 120, an early detection system 190, one or more client devices 110, and an HVAC system 180. In the shown embodiment, the communication device 120, the early detection system 190, and the one or more client devices 110 are each operably connected to a computer network 150, which enables operable communication between these devices. The communication device 120 may be operably connected to the HVAC system 180 to enable one or more parameters of the HVAC system 180 to be monitored by the communication device 120. In the shown embodiment, the communication device 120 comprises an input sensor 130, an output sensor 140, a current probe 160, and a network connection device 170, any two or more of which may be operably connected to each other to carry out one or more operations of the communication device 120. In the shown embodiment the continuous monitoring system is comprised of a networked configuration, which may be advantageous for centralized monitoring of a plurality of HVAC systems 180 installed in a plurality of different locations. In embodiments, the continuous monitoring system may be reorganized or consolidated to perform the operations of the present invention on one or more other servers or computing devices without departing from the scope of the invention.

The HVAC system 180 may be comprised of a heating, ventilation, and cooling system (HVAC system) installed in a building such as a business or home. Any of a variety of different HVAC systems 180 may be utilized with the continuous monitoring system without departing from the scope of the present invention. In embodiments, the HVAC system 180 may be comprised of a heating component, such as a boiler, which may be used to generate heat for the building. The HVAC system 180 may comprise an air flow component, which is provided by an air handler and a blower fan, and may also comprise an air conditioning component which may provide cooling and humidity control for the building, whether in the form of an air conditioner or a chiller to distribute cool water into the air handler.

A communication device 120 may be installed at a physical location of the HVAC system 180, and one or more sensors (130, 140), one or more probes (160), or both, may be operably connected to one or more components of the HVAC system 180 for monitoring one or more parameters thereof. As a non-limiting example, the input sensor 130 may be a thermometer positioned and configured to measure a temperature at an input of a heat exchanger of the climate control system, and the output sensor 140 may be a thermometer positioned and configured to measure a temperature at an output of the heat exchanger, and in this manner, a temperature differential (e.g., delta T) and actual run time may be monitored by the early detection system 190. If the temperature differential is non-zero then the HVAC system is operative, and by computing a sign of the temperature differential as positive or negative, the mode of operation of the HVAC system may be deduced. As another example, the input sensor 130 may be a pressure sensor positioned and configured to measure air pressure at an input of the HVAC system, and the output sensor 140 may be a pressure sensor positioned and configured to measure air pressure at an output of the HVAC system, and in this manner, a pressure differential (e.g., delta P) and actual run time may be monitored by the early detection system 190.

In embodiments, the current probe 160 may be positioned and configured to detect and measure electrical current at a thermostat of the HVAC system, at a blower fan of the HVAC system, or both. Current detected at the thermostat may indicate a calling event of the thermostat, wherein the calling event comprises sending an electrical signal to the HVAC system to request heating or cooling for a controlled climate such as an indoor space of the building. Current at the blower fan may indicate actual operation of the HVAC system. By measuring one or more electrical currents with one or more current probes 160, the monitoring system may monitor and record actual run time of the HVAC system, which may be used to compute actual run time percentage (ART), as described elsewhere herein.

In embodiments, operational data of the HVAC system, which may include one or more temperature differentials, one or more pressure differentials, one or more actual run times, lengths of one or more observation periods, or any combination thereof, may be encoded on a non-transitory computer readable storage medium of the communication device 120 prior to transmittal over a network link of network connection device 170, which operably connects the communication device 120 to the early detection system 190 via network 150. Once the operational data reaches the early detection system 190, the operational soundness of the HVAC system 180 may be evaluated through the application of one or more computational operations of the present invention.

In embodiments, network 150 may comprise an internet (e.g., the world wide web), an intranet, or a combination thereof, over which the communication device 120, the early detection system 190, and the one or more client devices 110 may operably communicate. In embodiments, the HVAC system 180 may be directly or indirectly operably connected to network 150. In embodiments, the communication device 120 may be directly or indirectly operably connected to network 150. In embodiments, the one or more client devices 110 and the early detection system 190 may be directly or indirectly operably connected to network 150. Any device of the continuous monitoring system may comprise one or more network connection devices or components (e.g., network connection device 170 of communication device 120), which may be wired (e.g., ethernet) or wireless (e.g., WiFi) such that the device is able to operably connect to network 150. Network 150 may comprise one or more networks or collections of networks, including but not limited to an intranet, an extranet, a virtual private network (VPN), a local area network (LAN), a wireless LAN (WLAN), a wide area network (WAN), a metropolitan area network (MAN), a portion of the world wide web, another network 150, and any combination thereof. In embodiments, one or more network links connects the devices and systems of the present invention to the network 150. In embodiments, such one or more network links may comprise one or more wired links, one or more wireless links, one or more optical links, or any combination thereof. In embodiments, such one or more network links may comprise an intranet, an extranet, a VPN, a LAN, a WLAN, a WAN, a MAN, a portion of the world wide web, another network link, or any combination thereof. The present invention may be compatible with any suitable network 150, and any suitable network link for connecting two or more devices or systems of the present invention may be utilized.

In embodiments, the early detection system 190 receives data comprising operational data of the HVAC system 180 and temperature data of an uncontrolled climate and performs one or more computational operations to monitor the HVAC system 180 and to evaluate operational soundness of the HVAC system 180. The uncontrolled climate may comprise any reference climate or space that is not subjected to climate control by the HVAC system 180, such as an attic or upper interior space of the building, a proximal exterior of the building, or a distal exterior of the building. For example, if the attic or upper interior space of the building serves as the uncontrolled climate, then temperature data may originate from one or more thermometers placed in the attic or upper interior space and may be transmitted to the early detection system 190 via the communication device 120 and network 150. Similarly, if the proximal or distal exterior of the building serves as the uncontrolled climate, then temperature data may originate from one or more thermometers placed outside the building and may be transmitted to the early detection system 190 via the communication device 120 and network 150. In embodiments, the one or more thermometers may be operably connected to the communication device 120, and in this manner, the temperature data may be captured by the communication device 120.

In embodiments, the temperature data may originate from one or more thermometers of a third party, such as a weather monitoring service. In embodiments, the temperature data may be stored in one or more networked servers of the third party and may be accessed utilizing one or more computer networking protocols via network 150. In this manner, a networked device of the present invention, including but not necessarily limited to the communication device 120, the one or more client devices 110, the early detection system 190, and any combination thereof, may access the temperature data of the third party. In embodiments, the early detection system 190 may automatically or programmatically request temperature data from the one or more networked servers of the third party. In this manner, the data required for the computational operations to evaluate operational soundness of the HVAC system 180 may be captured and utilized with little or no manual instructions.

In embodiments, the one or more client devices 110 may provide data which is collected therefrom and may also initiate requests for data from a remote or networked system, e.g., the early detection system 190. The one or more client devices 110 may access or receive alerts or warnings generated by the early detection system 190. The alerts or warnings may notify a user of the one or more client devices 110, e.g., a person tasked with managing the HVAC system 180, to take appropriate action to address an issue with the HVAC system 180 before the HVAC system 180 fails.

In embodiments, the alert or warning may originate from a computational device that comprises the non-transitory computer readable storage medium. The computational device may comprise one or more of the communication device 120, the one or more client devices 110, and the early detection system 190. However, in particular embodiments, the alert or warning may originate from the early detection system 190, as this may be advantageous for a networked configuration, e.g., as shown in FIG. 1. The early detection system 190 may issue the alert or warning to one or more users (e.g., users of the one or more client devices 110) via electronic mail (email), text message, push notification, another type of alert or warning, or any combination thereof.

In embodiments, the one or more client devices 110 and the early detection system 190 may comprise any suitable computer or computing device which includes functionality for communicating over network 150. Exemplary computing devices include, but are not necessarily limited to, a server, a desktop computer, a laptop computer, a notebook computer system, a netbook computer system, a handheld electronic device, a personal digital assistant (PDA), an in- or out-of-vehicle navigation system, a smart phone, a cellular phone, a mobile phone, a mobile gaming device, and any other suitable computing device. The present disclosure contemplates any suitable device which may be utilized for the one or more client devices 110 and the early detection system 190. The suitable devices may enable a user thereof to access network 150 and may also enable the user thereof to communicate with users of one or more other client devices 110. In embodiments, a computing device may comprise a software application encoded on one or more non-transitory computer readable storage mediums of the device. Such software applications may be configured to retrieve data via network 150 and display a visual representation of the data to a user via one or more user interfaces of the one or more client devices 110, the early detection system 190, or both.

In embodiments, the one or more client devices 110 and the early detection system 190 may each be comprised of one or more computing systems that assume any suitable physical form. As a non-limiting example, the one or more computing systems may comprise an embedded computer system, a system-on-chip (SOC), a single-board computer system (SBC) (e.g., a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, or any combination thereof. A computing system may include one or more computer systems, be unitary or distributed, span multiple locations, span multiple machines, or reside in a cloud, which may comprise one or more cloud components in one or more networks. In embodiments, a device or a system of the present invention may perform all or part of a computational operation of the present invention, whether the operation is performed in an order disclosed herein or in an alternate order, with or without temporal or spatial differences. For example, one or more computing devices or systems may perform, in real time or in batch mode, one or more steps of one or more operations described or illustrated herein. One or more computing systems may perform at different times or at different locations the one or more steps of the one or more operations described or illustrated herein, as applicable.

In embodiments, the one or more client devices 110 may execute one or more client software applications, such as a web browser (e.g., Microsoft Internet Explorer, Mozilla Firefox, Apple Safari, Google Chrome, Opera, etc.) or a dedicated software application to send and receive data over network 150, and may be utilized to communicate with the early detection system 190. In embodiments, the one or more client devices 110 may comprise an electronic device which includes suitable hardware, software, or embedded logic components, or any combination thereof, such that the components of the one or more client devices 110 are able to perform computational operations and other appropriate functions which are implemented or supported by the one or more client devices 110. In embodiments, the one or more client devices 110 may enable a user thereof to enter a Uniform Resource Locator (URL) or other address directing the web browser or dedicated software application to a networked server (e.g., the early detection system 190), and the web browser or dedicated software application may generate a Hyper Text Transfer Protocol (HTTP) request and transmit the HTTP request to the networked server, e.g., via network 150. The networked server may accept the HTTP request and communicate to the one or more client devices 110 one or more Hyper Text Markup Language (HTML) files responsive to the HTTP request. The one or more client devices 110 may render web pages, or other user interfaces, based on the one or more HTML files received from the networked server, for presentation to the user. In embodiments, any suitable web page file may be utilized, including but not necessarily limited to HTML files, eXtensible Hyper Text Markup Language (XHTML) files, eXtensible Markup Language (XML) files, and the like. In embodiments, such web pages may execute one or more scripts, such as one or more Javascript files, one or more Java files, one or more Microsoft Silverlight files, one or more markup language files, one or more Asynchronous Javascript and XML (AJAX) files, and the like. Reference to a web page may encompass one or more corresponding web page files, which the browser or dedicated software application may use to render the web page or user interface, and vice versa, where appropriate.

In embodiments, one or more components of the present invention (e.g., one or more devices, systems, or engines) may comprise a unitary or centralized networked server, or may be a distributed networked server which spans multiple computers or multiple datacenters. Devices, systems, engines, or modules may be any of various types, including but not necessarily limited to a web server, a news server, a mail server, a message server, an advertising server, a file server, an application server, an exchange server, a database server, a proxy server, and any combination thereof. In embodiments, a device, system, engine, or module may comprise suitable hardware, software, embedded logic components, or any combination thereof configured to carry out the operations and functionalities implemented or supported by their respective servers. For example, a web server may be configured for hosting websites containing web pages or elements of web pages; a web server may host HTML files or other file types, or may dynamically create or constitute files upon request and transmit them to the one or more client devices 110 or other devices in response to HTTP or other requests from the one or more client devices 110 or other devices. Similarly, a mail server may be configured for providing electronic mail (Email) services to the one or more client devices 110 or other devices. Further, a database server may be configured for providing an interface for managing data stored in one or more data stores.

In embodiments, one or more data stores may be communicatively linked to one or more servers via one or more links which may comprise physical components, logical components, or both. In embodiments, the one or more data stores may be used to store any of various types of information, and the information stored in the one or more data stores may be organized according to specific data structures. In embodiments, the one or more data stores may comprise a database such as a relational database. In embodiments, the one or more servers may provide one or more interfaces that enable servers or one or more client devices 110 to manage, e.g., retrieve, modify, add, or delete, all or part of the information stored in the data store.

In embodiments, a device or system of the present invention may also comprise other subsystems and databases, which while not illustrated in FIG. 1, would be readily apparent to a person of ordinary skill in the art. For example, the device or system may comprise databases for storing data, features, outcomes (e.g., training sets), models, or any combination thereof. Other databases and systems may be added or subtracted, as would be apparent to the person of ordinary skill in the art, without departing from the scope of the present invention.

Figure 2A:
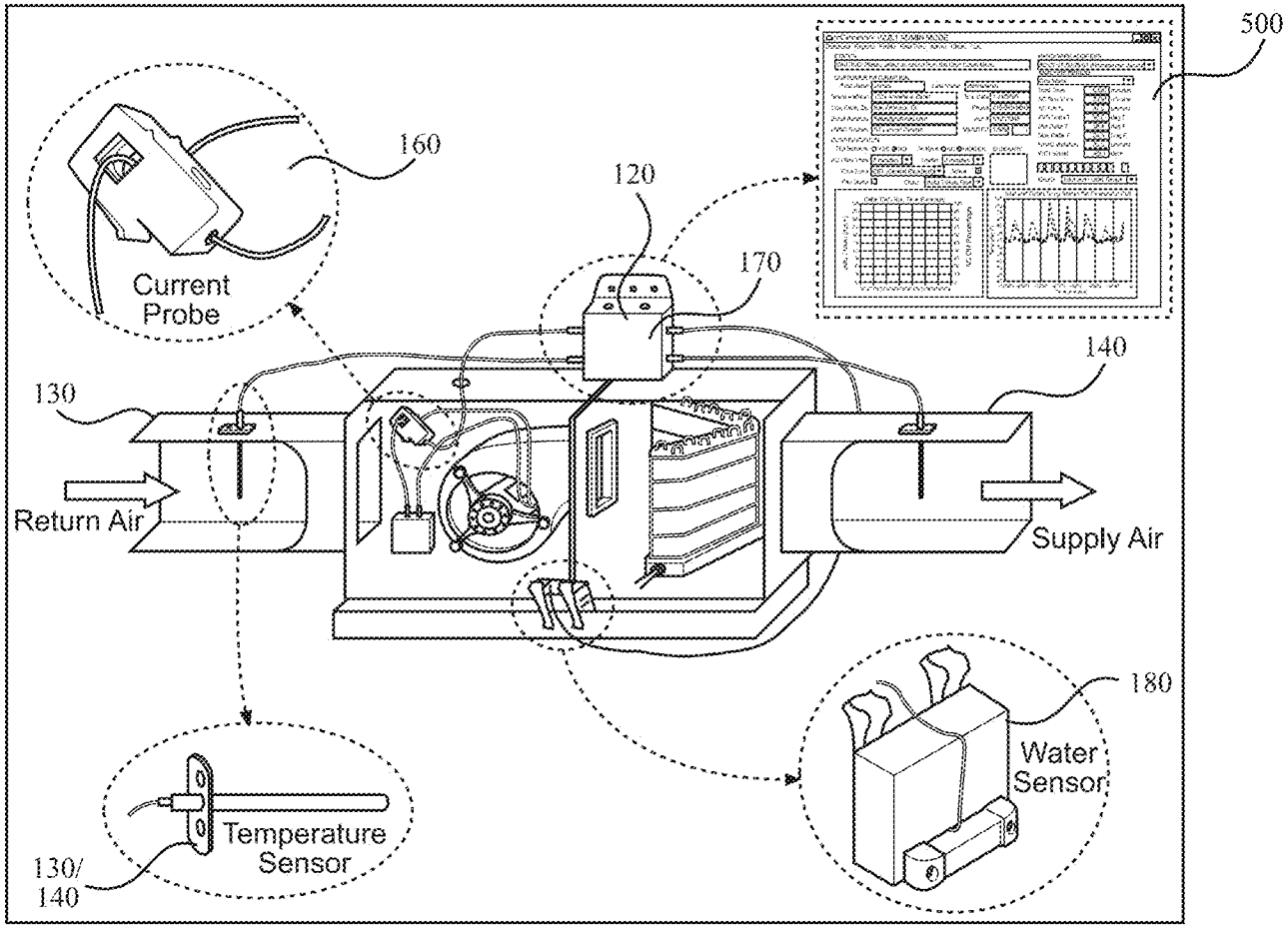
FIG. 2A depicts an illustration of an exemplary continuous monitoring system with connected sensors according to the present invention.

Referring now to FIG. 2A, there is depicted an illustration of an exemplary continuous monitoring system with connected sensors according to the present invention. In the shown embodiment, a plurality of sensors comprises a current probe 160, a water sensor 180, an input temperature sensor 130, and an output temperature sensor 140, however, in embodiments, the plurality of sensors may comprise an input pressure sensor and an output pressure sensor. In the shown embodiment, the current probe 160 is installed at a blower fan of the HVAC system and is positioned and configured to detect and measure current over an observation period for determination of actual run time and actual run time percentage (ART) of the HVAC system. In addition, in the shown embodiment, the input temperature sensor 130 is positioned at a return air plenum of the HVAC system, and the output temperature sensor 140 is positioned at a supply air plenum of the HVAC system. In this manner, the input and output sensors (130, 140) are configured to measure temperature at the input of the HVAC system and the output of the HVAC system to enable calculation of the temperature differential by the early detection system, which also enables determination of actual run time and ART of the HVAC system over the observation period. The communication device 120 may comprise a suitable housing for holding the network connection device 170 therein, such that the network connection device 170 and any other sensitive electronic components of the communication device 120 are not subjected to damaging temperature, moisture, or humidity, thereby extending the usable life of the communication device 120. In embodiments, the water sensor 180 may be included in an installation of the communication device 120 to detect blockage of the air conditioning (AC) condensing drain line as the AC drain pan fills with water, as may occur in the absence of a condensate shut off float switch. In embodiments, one or more sensors of the plurality of sensors may be operably connected to the communication device 120, and may be configured to regularly, periodically, or continuously transmit sensor data (e.g., data relating to input temperature, output temperature, input pressure, output pressure, electrical current, etc.) to the communication device 120 or a component thereof for storage or transmission to the early detection system. Alternate types, numbers, configurations, placements, and implementations of sensors may be constructed and used without departing from the scope of the present invention.

In embodiments, the current probe 160 may measure electrical current flowing through one or more portions of the HVAC system. In embodiments, the current probe 160 detects ON/OFF events of the HVAC system; for example, an ON event may be detected when electrical current is present and measured, and an OFF event may be detected when electrical current is not present and measured, or when an insignificant amount of electrical current is present and measured. The ON/OFF status of the HVAC system may be automatically and regularly or periodically transmitted to the communication device 120 or a component thereof. In embodiments, the current probe 160 may measure variances in the electrical current, as may be necessary to determine whether the HVAC system is operating in a particular mode of operation, such as a FAN ON/SYSTEM OFF mode. For example, a lower level of blower fan current may indicate the FAN ON/SYSTEM OFF mode, while a higher level of blower fan current may indicate an HVAC ON mode. In embodiments, if the FAN ON/SYSTEM OFF mode is detected, data obtained during usage of this or similar modes of the HVAC system may be omitted from one or more computational operations of the present invention, as the operational soundness of the HVAC system with blower fan usage, without heating or cooling enabled, may not be representative of the overall operational soundness of the HVAC system.

Figure 2B:
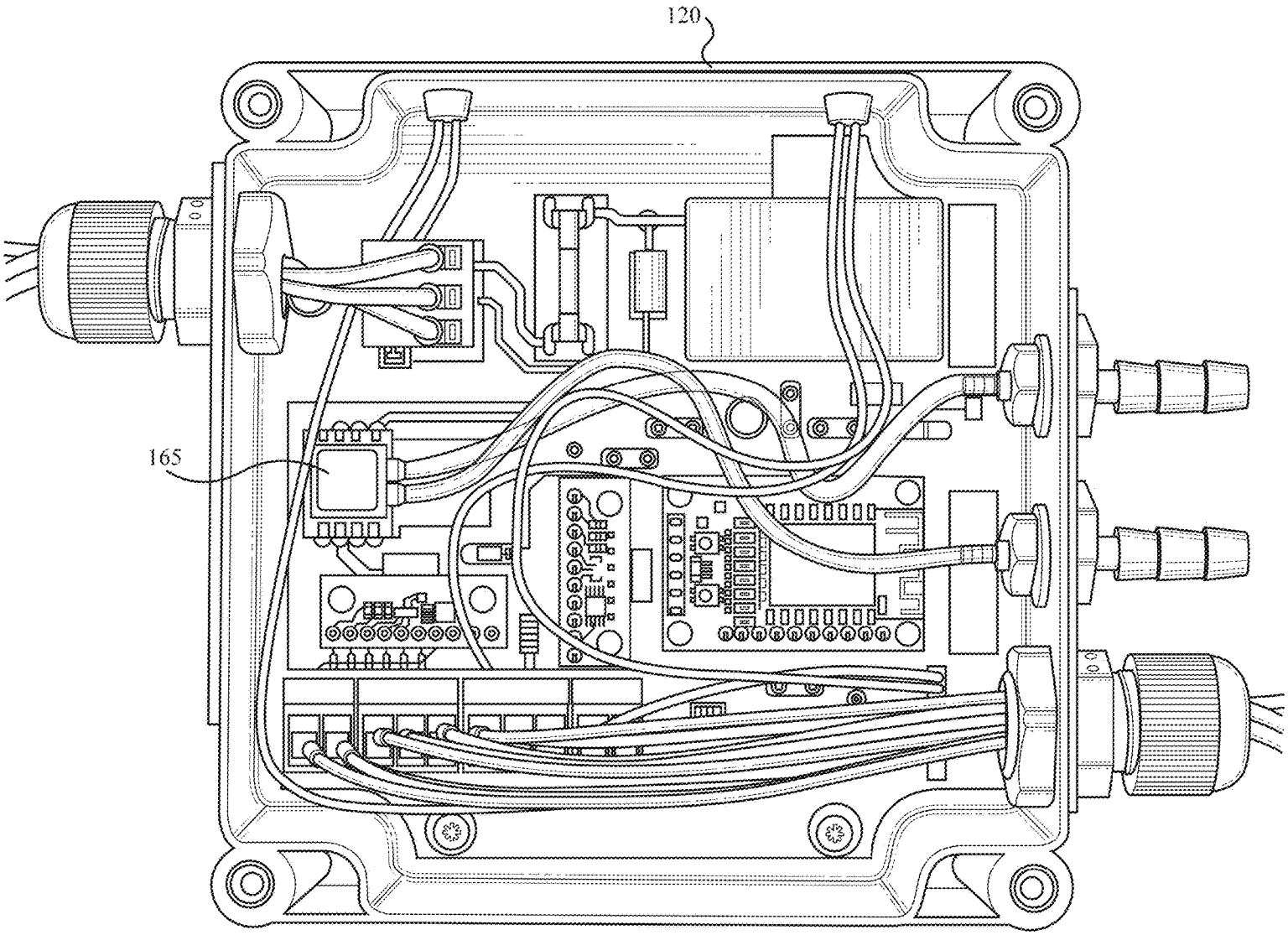
FIG. 2B depicts an illustration of an exemplary communication device of the continuous monitoring system.

Referring now to FIG. 2B, there is depicted an illustration of an exemplary communication device of the continuous monitoring system. In the shown embodiment, the communication device 120 comprises a pressure sensor 165 which is positioned and configured to measure a pressure differential, or pressure drop, across a filter of the HVAC system (e.g., delta P) which may be utilized to detect an ON mode of the HVAC system and which may also be utilized to determine when to clean or replace the filter. In embodiments, the pressure sensor 165 may connect with pressure ports, via tubing, installed upstream and downstream of the filter of the HVAC system for measurement of the pressure differential across the filter. In embodiments, the pressure differential measurement may be performed by the input pressure sensor and the output pressure sensor when the HVAC system is operative, and may be measured continuously or discretely during an observation period. Data comprising an input pressure value, an output pressure value, a pressure differential value, or any combination thereof, may be transmitted to the early detection system for monitoring and performing computational operations. If the pressure differential value is outside an acceptable range (i.e., above an upper limit of the acceptable range or below a lower limit of the acceptable range), an alert may be generated and transmitted to one or more individuals via one or more devices or systems of the present invention, and in this manner, the one or more individuals may replace the dirty or damaged filter to ensure sound operation of the HVAC system. In embodiments, a pressure differential reference value may be computed based on the pressure differential observed immediately following installation of a new filter, and this reference value may be used as the basis for computing the acceptable range for the pressure differential value. In embodiments, the acceptable range for the pressure differential may be 75% to 125% of the reference value, however, this range is exemplary and other ranges may be utilized without departing from the scope of the present invention.

Figure 3:
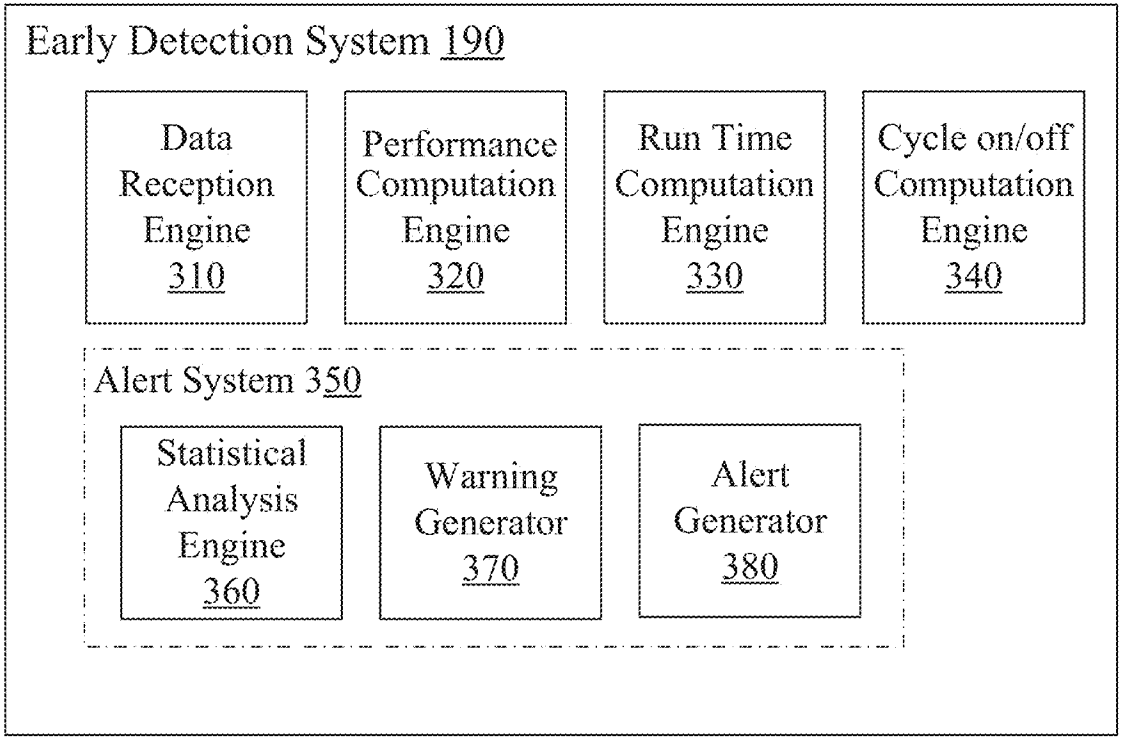
FIG. 3 depicts a diagram of an exemplary early detection system of the continuous monitoring system.

Referring now to FIG. 3, there is depicted a diagram of an exemplary early detection system of the continuous monitoring system. In the shown embodiment, the early detection system 190 comprises a plurality of computational engines (310, 320, 330, 340) and an alert system 350 which is comprised of a statistical analysis engine 360, a warning generator 370, and an alert generator 380. In embodiments, one or more of these components may be subcomponents of instructions encoded on a non-transitory computer readable storage medium of the early detection system 190. In embodiments, the instructions may be executable by one or more processors, such as one or more hardware processors, to perform one or more operations of the present invention. The one or more processors may be components of the early detection system 190. One or more of the engines, including the data reception engine 310, the performance computation engine 320, the run time computation engine 330, the cycle on/off computation engine 340, and the statistical analysis engine 360, may be in the form of one or more software modules, functions, classes, executable scripts, or any other object or collection of objects, whether physical, logical, or both physical and logical, which may be constructed to perform one or more operations of the present invention. In embodiments, two or more of these components of the early detection system 190 may be directly or indirectly operably connected to each other to facilitate the processing and transmission of data relating to operation of the HVAC system.

In embodiments, the data reception engine 310 serves as an interface with the communication device, and may receive input temperature data, output temperature data, electrical current data, water detection data, or any combination thereof, from one or more of the sensors and probes installed to the HVAC system and, if applicable, installed to the uncontrolled climate or space. Accordingly, in embodiments, the data reception engine 310 may also receive temperature data of the uncontrolled climate, whether the uncontrolled climate is local or distal to the HVAC system, and whether or not the temperature data is obtained from the third party (e.g., the weather monitoring service or system). Data received by the data reception engine 310 may be processed and forwarded to one or more other engines, as described herein, for computational operations to evaluate the soundness of the HVAC system. In this manner, due to a modular design of the early detection system 190, easier maintenance of the system and improved interoperability of the different engines may be achieved.

In embodiments, the cycle on/off computation engine 340 computes the number of times the HVAC system turns on, turns off, or both, within an observation period, and may also compute a frequency with which the HVAC system turns on, turns off, or both, during the observation period or a subset thereof. In embodiments, the cycle on/off computation may be calculated by summing a plurality of on periods, separated by one or more off periods, of the observation period of a subset thereof. In embodiments, the cycle on/off computations may be computed regularly, periodically, irregularly, or continuously. The observation period may be one or more minutes, hours, days, weeks, or a longer period, as needed for a particular embodiment. In embodiments, a relatively high number or frequency of on/off cycles, which may be coupled with a relatively shorter run time per on period, may be referred to as short cycling. If the HVAC system is short cycling, e.g., not running for long periods of time, this may suggest that the HVAC unit is too large or too productive for the size of the controlled climate or space. Such a configuration may place undue strain on the HVAC system and may expedite degradation or failure. Accordingly, in embodiments, if the cycle on/off computation engine 340 detects short cycling, one or more signals may be transmitted to the alert system 350, or an engine or generator thereof, to further evaluate the short cycling, to generate a warning, to generate an alert, or any combination thereof.

In embodiments, the run time computation engine 330 computes one or more run times from HVAC system operational data received from the data reception engine 310. The operational data may comprise input temperature data, output temperature data, electrical current data, water detection data, or any combination thereof, such that the operational data enables the run time computation engine 330 to compute the run time. The operational data may be captured or received regularly or periodically, or irregularly; in embodiments, the run times of a plurality of on periods may be summed to produce an actual run time for the observation period, such as a 24-hour period. In embodiments, the operational data may be continuously received and utilized by the run time computation engine 330. In embodiments, the operational data may be received and utilized by the run time computation engine 330 once per 24-hour period. In embodiments, an analysis period spanning all or part of one or more observation periods may be utilized, such that the run time may be computed for any past or present period, as needed.

In embodiments, the performance computation engine 320 performs one or more computational operations to evaluate the operational soundness of the HVAC system. As described elsewhere herein, such computational operations may comprise receiving operational data of the HVAC system. The operational data may be received from the data reception engine 310, the cycle on/off computation engine 340, the run time computation engine 330, or any combination thereof. However, in particular embodiments, the operational data may be received from the run time computation engine 330, and the evaluation of the operational soundness of the HVAC system may involve analyzing run time data and temperature data.

In embodiments, operations of the performance computation engine 320 comprise receiving operational data of the HVAC system and computing the actual run time percentage (ART) of the HVAC system for an observation period or an analysis period. The ART may be computed by summing the lengths of a plurality of on periods (i.e., periods during which the HVAC system is operational) to produce an actual run time, dividing the actual run time by the length of the observation period or the analysis period, and expressing the resultant ratio as a percentage. In embodiments, operations of the performance computation engine 320 comprise receiving temperature data of the uncontrolled climate (e.g., the attic, the upper interior space, the proximal outdoor space, the distal outdoor space, or any combination thereof) and computing an estimated run time percentage (ERT) of the HVAC system using the temperature data and a degree day (DD) such as a heating degree day (HDD) or a cooling degree day (CDD). In embodiments, if the ART deviates from the ERT or a range thereof, one or more signals may be transmitted to the alert system 350, the statistical analysis engine 360, the warning generator 370, the alert generator 380, or any combination thereof, to initiate a process which may result in the generation of a warning or alert, as described elsewhere herein.

In embodiments, the performance computation engine 320 may compute one or more temperature differentials (e.g., delta T) of the HVAC system using operational data received from the data reception engine 310. The temperature differential may be utilized to deduce an operational mode (e.g., heating mode, cooling mode, fan mode, etc.), compute the actual run time for the observation period, and compute the ART for the observation period. In embodiments, the temperature differential may be computed by subtracting an input temperature from an output temperature. In embodiments, a plurality of historical temperature differentials may be used to compute an average or a moving average of the temperature differential, and one or more statistical analyses may be performed by the statistical analysis engine 360 to compute an acceptable range for the temperature differential. Over the course of an observation period, if the observed temperature differential differs substantially from the expected temperature differential, e.g., as defined by the acceptable range of the temperature differential, one or more signals may be transmitted to the alert system 350, the statistical analysis engine 360, the warning generator 370, the alert generator 380, or any combination thereof, to initiate a process which may result in the generation of a warning or alert, as described elsewhere herein.

In embodiments, the early detection system 190 comprises the alert system 350 which may generate an alert or warning if it is determined that one or more operational parameters of the HVAC system are unacceptably out of range or significantly different from a reference value. In embodiments, the alert system 350 comprises the statistical analysis engine 360, the warning generator 370, and the alert generator 380. In embodiments, an alert issued by the alert generator 380 may indicate a less critical problem with the HVAC system, and a warning issued by the warning generator 370 may indicate a more critical problem with the HVAC system.

In embodiments, the statistical analysis engine 360 may compute the statistical variance of a parameter of the HVAC system, such as the temperature differential, for an observation period. The statistical variance may be computed by calculating one or more standard deviations of the temperature differential over the observation period, and a range for the temperature differential (e.g., having an upper limit and a lower limit) may be computed based on the computed statistical variance. In embodiments, the upper delta T limit may be five to six or approximately six standard deviations higher than a mean of the delta T values, and the lower delta T limit may be five to six or approximately six standard deviations lower than the mean of the delta T values, thereby defining an expected range for the temperature differential. If a measured or actual temperature exceeds the upper delta T limit or the lower delta T limit, one or more signals may be transmitted to the warning generator 370, the alert generator 380, or both, for further processing. In embodiments, the use of a mean absolute deviation from the median statistical algorithm may minimize the influence of outlier data points when computing the upper delta T limit and the lower delta T limit. However, in embodiments, any suitable statistical calculation or computation may be performed without departing from the scope of the present invention.

In embodiments, one or more components of the alert system 350, including but not necessarily limited to the warning generator 370 and the alert generator 380, may transmit one or more signals from the early detection system 190 to one or more client devices, via a network, as part of a notification function of the one or more client devices. Such a notification function may inform one or more users of the one or more client devices about a newly observed problem or previously observed problem with the HVAC system which may require intervention. In embodiments, the alert system 350 may receive one or more signals from the performance computation engine 320 which relate to similarities or differences between the ART and the ERT or a range thereof. For example, if the ART differs significantly or substantially from the ERT or a range thereof, as determined by the performance computation engine, one or more signals may be transmitted to the alert system 350, the warning generator 370, the alert generator 380, or any combination thereof, for further processing and initiation of a process to notify the one or more client devices of the issue. In embodiments, the issue may relate to a temperature differential being out of range, a pressure differential being out of range, detection of water by one or more water sensors, a high cycling rate, a low cycling rate, the presence of network connection issues, dysfunction of one or more sensors or probes of the communication device, and the like.

Figure 4:
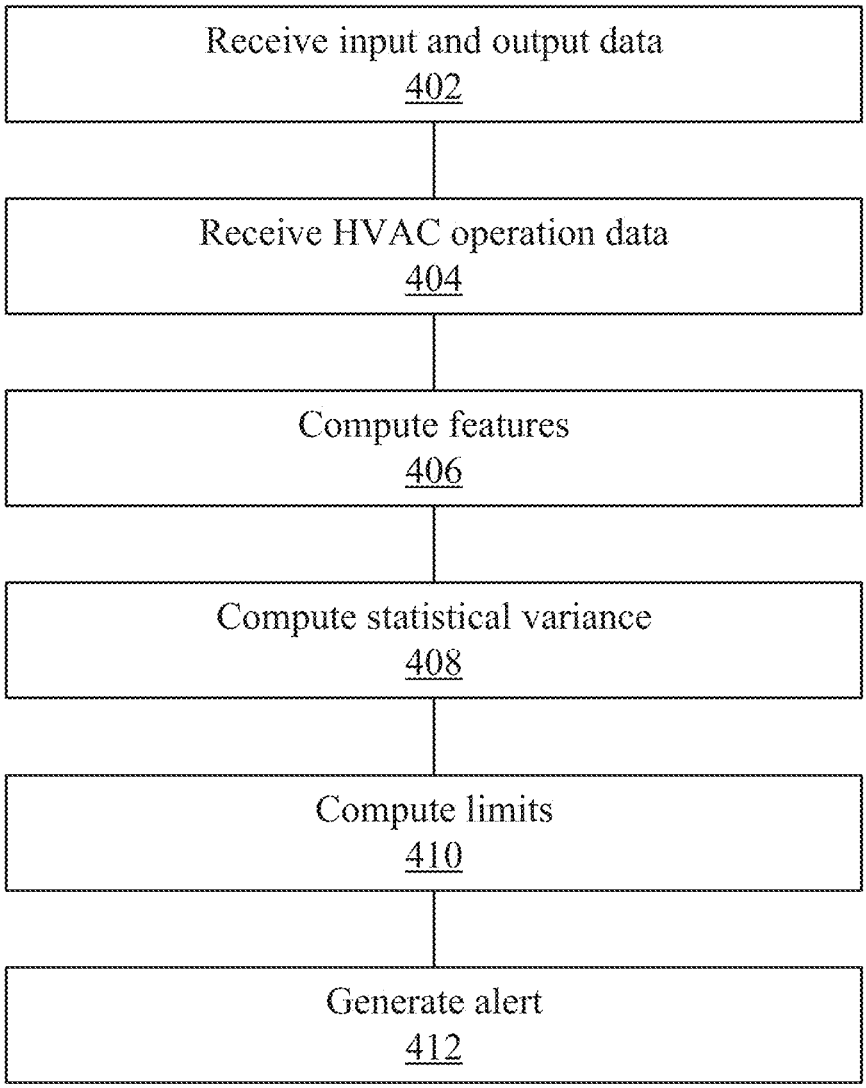
FIG. 4 depicts a flowchart of an exemplary first process for generating alerts by the continuous monitoring system.

Referring now to FIG. 4, there is depicted a flowchart of an exemplary first process for generating alerts by the continuous monitoring system. In embodiments, a process for generating a warning or an alert may comprise receiving 402 input and output data (e.g., input temperature data and output temperature data, input pressure data and output pressure data, etc.), receiving 404 HVAC operation data (e.g., actual run time values, cycle on/off values, etc.), computing 406 features (e.g., determining whether to include or exclude temperature data during calculation of a temperature differential), computing 408 statistical variance 408 (e.g., of the delta T values or the delta P values), computing 410 limits which define an acceptable range for a particular parameter (e.g., delta T value threshold limits, delta P value threshold limits, etc.), and if the actual observed parameter differs from the expected values thereof, generating 412 an alert or warning for notifying users of the continuous monitoring system.

Figure 5A:
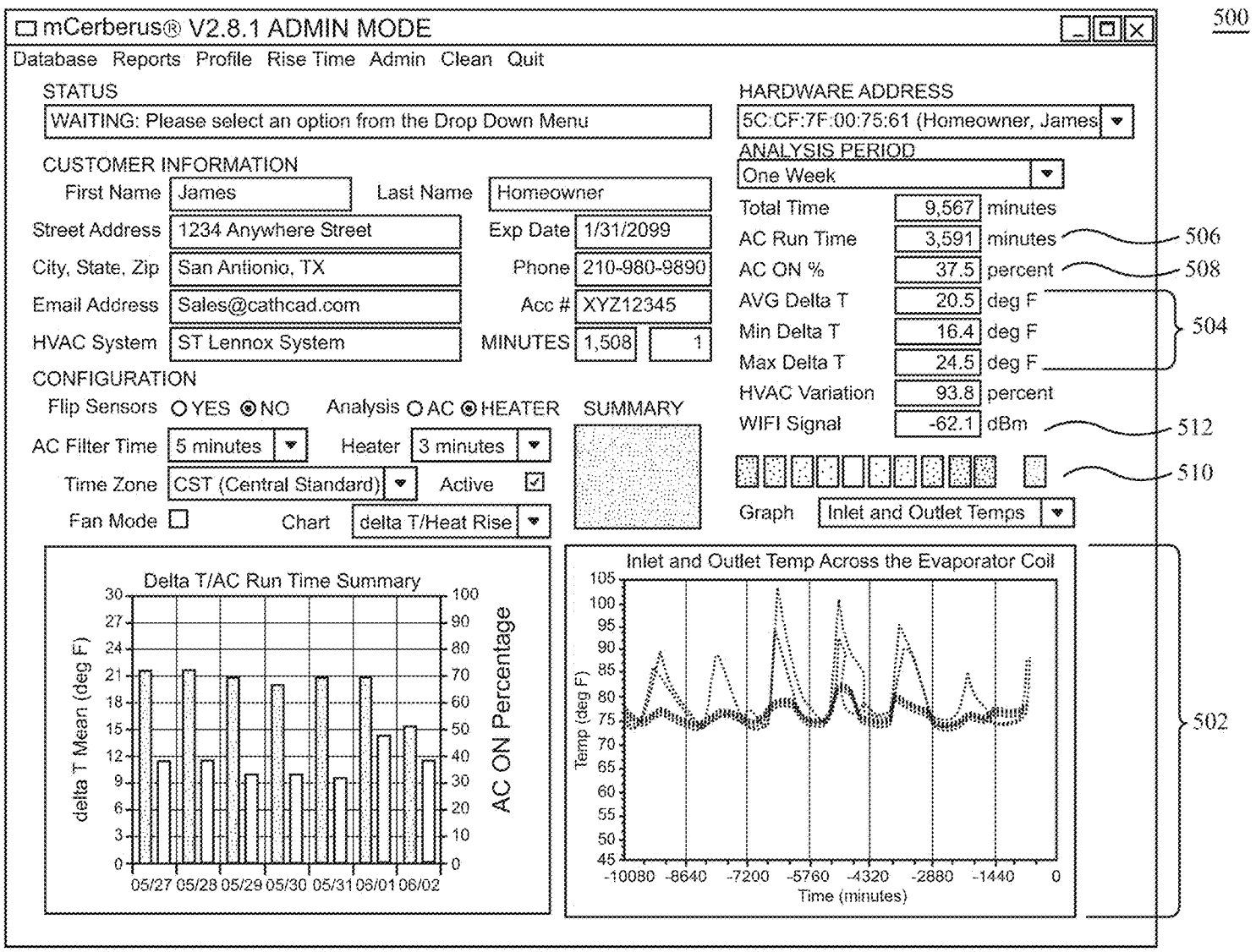
FIG. 5A depicts an illustration of an exemplary user interface of the continuous monitoring system.

Referring now to FIG. 5A, there is depicted an illustration of an exemplary user interface of the continuous monitoring system. In the exemplary embodiment, the graphical user interface 500 may visually depict data including, but not necessarily limited to: temperature input data and output data 502, temperature differential values 504, and other operational data such as the actual run time 506. In embodiments, the AC Run Time select box 506 may correspond to the run time computation engine, and the AC ON % select box 508 may correspond to the cycle on/off computation engine.

Figure 5B:
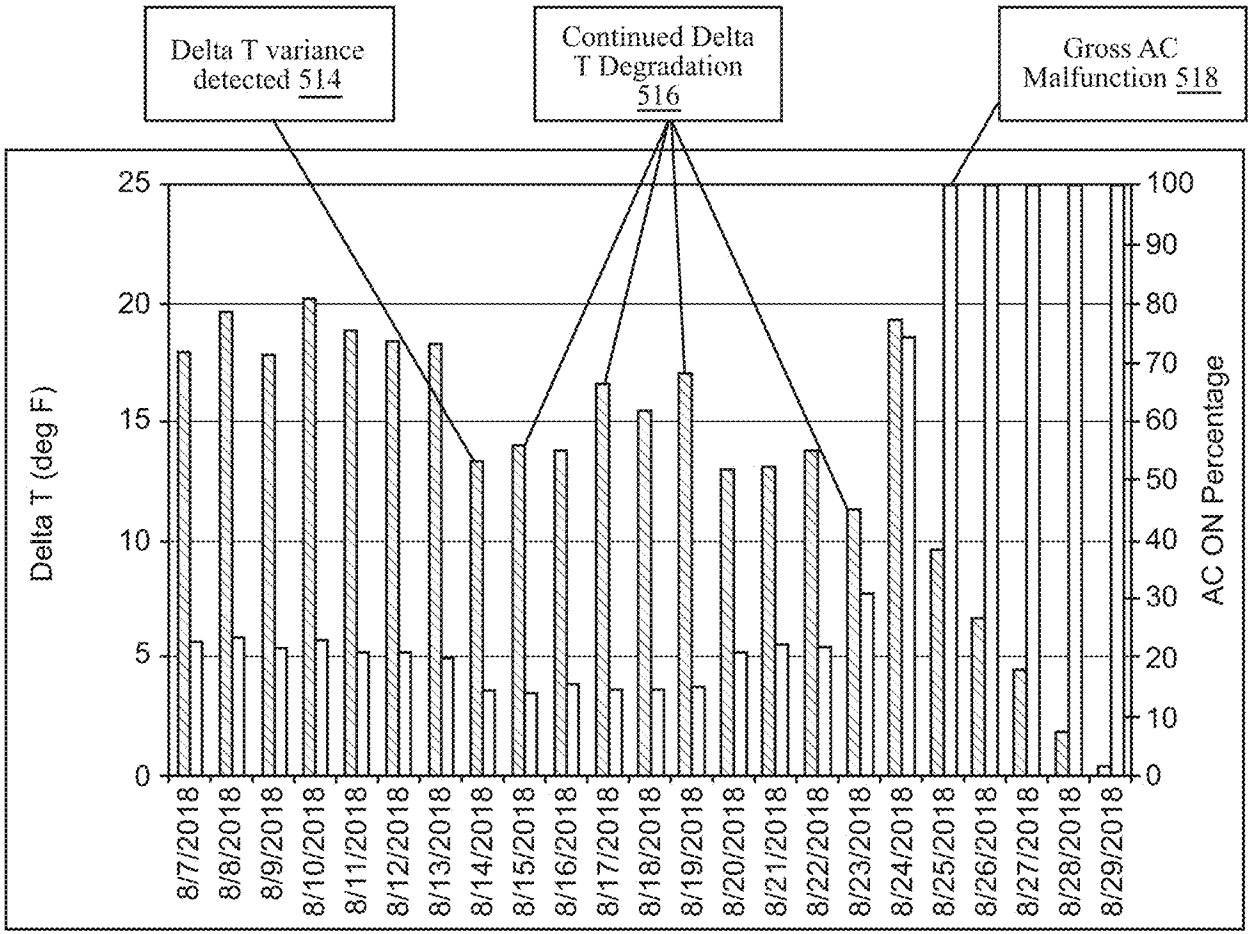
FIG. 5B depicts an illustration of results from the exemplary first process for generating alerts by the continuous monitoring system.

Referring now to FIG. 5B, there is depicted an illustration of results from the exemplary first process for generating alerts by the continuous monitoring system, which compares an observed temperature differential to an expected range for the temperature differential, and if the observed delta T is outside the expected range, then a warning or alert may be issued. In the shown embodiment, an initial variance of the delta T is detected 514, which is followed by a subsequent variance of the delta T detected 516. As the HVAC system continues to decline in operational soundness, gross system malfunction 518, which may be characterized as having a 100% (always on) run time percentage, may be observed.

Figure 6:
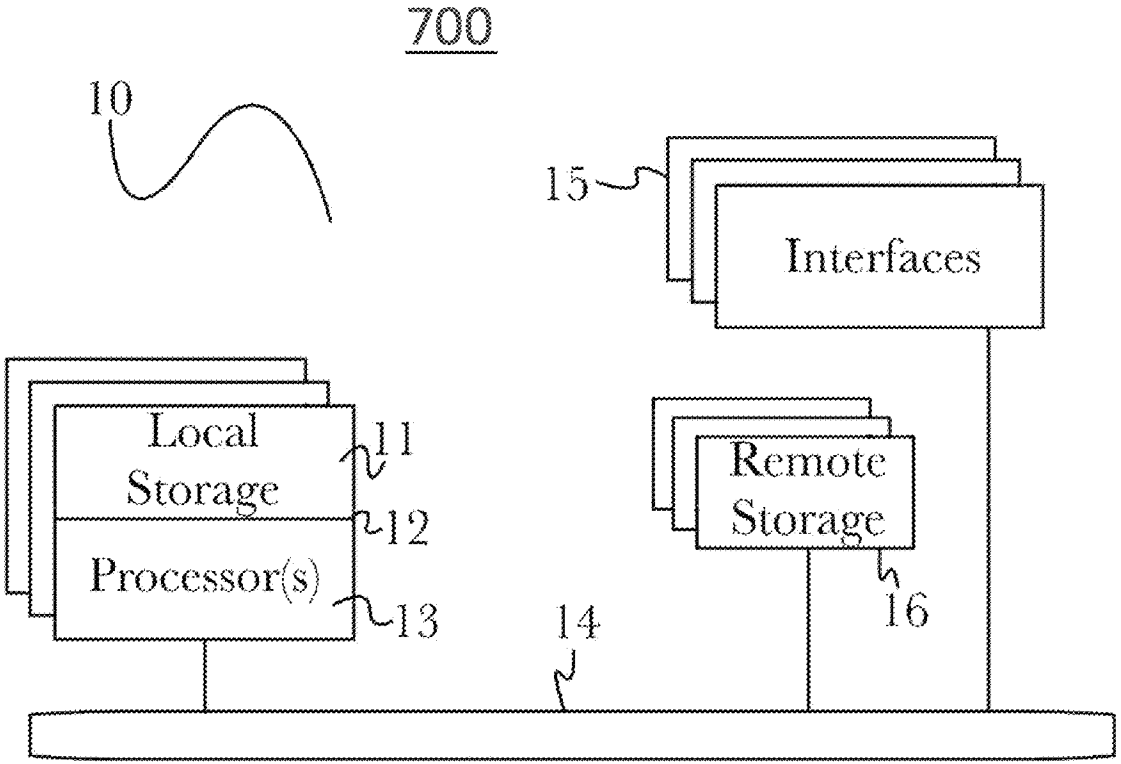
FIG. 6 depicts a diagram of components of an exemplary machine able to read instructions from a computer-readable storage medium and execute them with a processor or controller.

Referring now to FIG. 6, there is depicted a diagram of components of an exemplary machine able to read instructions from a computer-readable storage medium and execute them with a processor or controller. A computing device 700 is generally suitable for executing all or part of one or more operations or functionalities disclosed herein. The computing device 700 may be any suitable computing machine, or any other electronic device capable of executing software-based instructions, hardware-based instructions, or instructions comprising both software and hardware elements, according to one or more programs stored in the computer-readable storage medium. The computing device 700 may be configured to communicate with one or more other computing devices, such as client devices or servers, over one or more communication networks, using one or more suitable protocols for such communication, whether wireless or wired.

In embodiments, computing device 700 may comprise one or more local memory storages 11, one or more central processing units (CPU) 12, one or more interfaces 15, and one or more busses 14 (e.g., one or more peripheral component interconnect (PCI) busses). When acting under the control of appropriate software or firmware, CPU 12 may be responsible for implementing specific functions associated with the functions of a specifically configured computing device or machine. For example, computing device 700, which includes a plurality of components 10 thereof, may be configured or designed to function as a server system utilizing CPU 12, one or more local memory storages 11, one or more remote memory storages 16, one or more interfaces 15, or any combination thereof. In embodiments, CPU 12 may be caused to perform one or more of the different types of functions or operations under the control of software modules or components, which for example, may include an operating system and any appropriate applications, software, drivers, and the like.

Accordingly, in embodiments, the operations disclosed herein may be implemented on hardware or a combination of software and hardware. For example, the operations may be implemented in an operating system kernel, in a separate user process, in a library package bound into network applications, on a specially constructed machine, on an application-specific integrated circuit (ASIC), or on a network interface card.

In embodiments, software-hardware hybrid implementations of at least some of the operations disclosed herein may be implemented on a programmable network-resident machine (which may include intermittently connected network-aware machines) selectively activated or reconfigured by a computer program stored in memory. Such network devices may have multiple network interfaces that may be configured or designed to utilize different types of network communication protocols. A general architecture for some of these machines may be described herein to illustrate one or more exemplary means by which a given unit of functionality may be implemented. According to embodiments, at least some of the features or functionalities disclosed herein may be implemented on one or more general-purpose computers associated with one or more networks, such as, for example, an end-user computer system, a client computer, a network server or other server system, a mobile computing device (e.g., tablet computing device, mobile phone, smartphone, laptop, or other appropriate computing device), a consumer electronic device, a music player, or any other suitable electronic device, a router, switch, or other suitable device, or any combination thereof. In embodiments, at least some of the features or functionalities may be implemented in one or more virtualized computing environments (e.g., network computing clouds, virtual machines hosted on one or more physical computing machines, or other appropriate virtual environments).

In embodiments, CPU 12 may comprise one or more processors 13 such as, for example, a processor from one or more of the Intel, ARM, Qualcomm, and AMD families of microprocessors. In embodiments, one or more processors 13 may comprise specially designed hardware such as application-specific integrated circuits (ASICs), electrically erasable programmable read-only memories (EEPROMs), field-programmable gate arrays (FPGAs), and so forth, for controlling operations of computing device 700 having components 10. In embodiments, a local memory 11 (e.g., non-volatile random-access memory (RAM), read-only memory (ROM), including for example one or more levels of cached memory, and the like) may also form part of CPU 12. However, there are many different ways in which memory may be coupled to components 10 of computing device 700. Memory 11 may be used for a variety of purposes such as, for example, caching or storing data, programming instructions, and the like. It should be appreciated that CPU 12 may be one or more of a variety of system-on-a-chip (SOC) types of hardware that may include additional hardware such as memory or graphics processing chips, such as a QUALCOMM SNAPDRAGON™ or SAMSUNG EXYNOS™ CPU as are becoming common in the art, such as for use in mobile devices or integrated devices.

As used herein, the term "processor" is not limited merely to those integrated circuits referred to in the art as a processor, a mobile processor, or a microprocessor, but broadly refers to a microcontroller, a microcomputer, a programmable logic controller, an application-specific integrated circuit, and any other programmable circuit.

In embodiments, one or more interfaces 15 are provided as network interface cards (NICs). Generally, NICs control the sending and receiving of data packets over a computer network; other types of interfaces 15 may support other peripherals used with computing device 10. Among the interfaces that may be provided are Ethernet interfaces, frame relay interfaces, cable interfaces, DSL interfaces, token ring interfaces, graphics interfaces, and the like. In addition, various types of interfaces may be provided such as, for example, universal serial bus (USB), serial, ethernet, FIREWIRE™, THUNDERBOLT™, PCI, parallel, radio frequency (RF), BLUETOOTH™, near-field communications (e.g., using near-field magnetics), 802.11 (WiFi), frame relay, TCP/IP, ISDN, fast ethernet interfaces, gigabit ethernet interfaces, serial ATA (SATA) or external SATA (ESATA) interfaces, high-definition multimedia interface (HDMI), digital visual interface (DVI), analog or digital audio interfaces, asynchronous transfer mode (ATM) interfaces, high-speed serial interface (HSSI) interfaces, point of sale (POS) interfaces, fiber data distributed interfaces (FDDis), and the like. Generally, such interfaces 15 may include physical ports appropriate for communication with appropriate media. In some cases, they may also include an independent processor (such as a dedicated audio or video processor, as is common in the art for high-fidelity AN hardware interfaces) and, in some instances, volatile and/or non-volatile memory (e.g., RAM).

Although the system depicted in FIG. 6 illustrates one specific architecture for a computing device 700 for implementing one or more of the embodiments described herein, it is by no means the only device architecture on which at least a portion of the features and techniques described herein may be implemented. For example, architectures having one or any number of processors 13 may be used, and such processors 13 may be present in a single device or distributed among any number of devices. In embodiments, single processor 13 handles communications as well as routing computations, while in other embodiments a separate dedicated communications processor may be provided. In embodiments, different types of features or functionalities may be implemented in a system according to the aspect that includes one or more client devices (such as a tablet device or smartphone running client software) and one or more server systems (such as a server system).

Regardless of network device configuration, in embodiments, the system may employ one or more memories or memory modules (such as, for example, remote memory 16, local memory 11, or both) configured to store data, program instructions for the general-purpose network operations, other information relating to the functionality of embodiments of the invention, or any combination thereof. Program instructions may control execution of, or comprise, an operating system, one or more applications, or both. Memory 11, memory 16, or both memories 11, 16 may be configured to store one or more data structures, configuration data, encryption data, historical system operations information, or any other specific or generic non-program information described herein or known in the art.

Because such information and program instructions may be employed to implement one or more embodiments described herein, at least some device or system embodiments may include one or more non-transitory machine-readable storage media, which, for example, may be configured or designed to store program instructions, state information, and the like for performing various operations described herein. Examples of such non-transitory machine-readable storage media include, but are not limited to, magnetic media such as hard disks, floppy disks, and magnetic tape; optical media such as CD-ROM disks; magneto-optical media such as optical disks, and hardware devices that are specially configured to store and perform program instructions, such as read-only memory devices (ROM), flash memory (as is common in mobile devices and integrated systems), solid state drives (SSD) and "hybrid SSD" storage drives that may combine physical components of solid state and hard disk drives in a single hardware device (as are becoming increasingly common in the art with regard to personal computers), memristor memory, random access memory (RAM), and the like. It should be appreciated that such storage means may be integral and non-removable (such as RAM hardware modules that may be soldered onto a motherboard or otherwise integrated into an electronic device), or they may be removable such as swappable flash memory modules (such as "thumb drives" or other removable media designed for rapidly exchanging physical storage devices), "hot-swappable" hard disk drives or solid state drives, removable optical storage discs, or other such removable media, and that such integral and removable storage media may be utilized interchangeably. Examples of program instructions include one or more of object code, such as may be produced by a compiler, machine code, such as may be produced by an assembler or a linker, byte code, such as may be generated by for example a JAVA™ compiler and may be executed using a Java virtual machine or equivalent, and files containing higher level code that may be executed by the computer using an interpreter (for example, one or more scripts written in Python, Perl, Ruby, Groovy, or any other scripting language).

Figure 7:
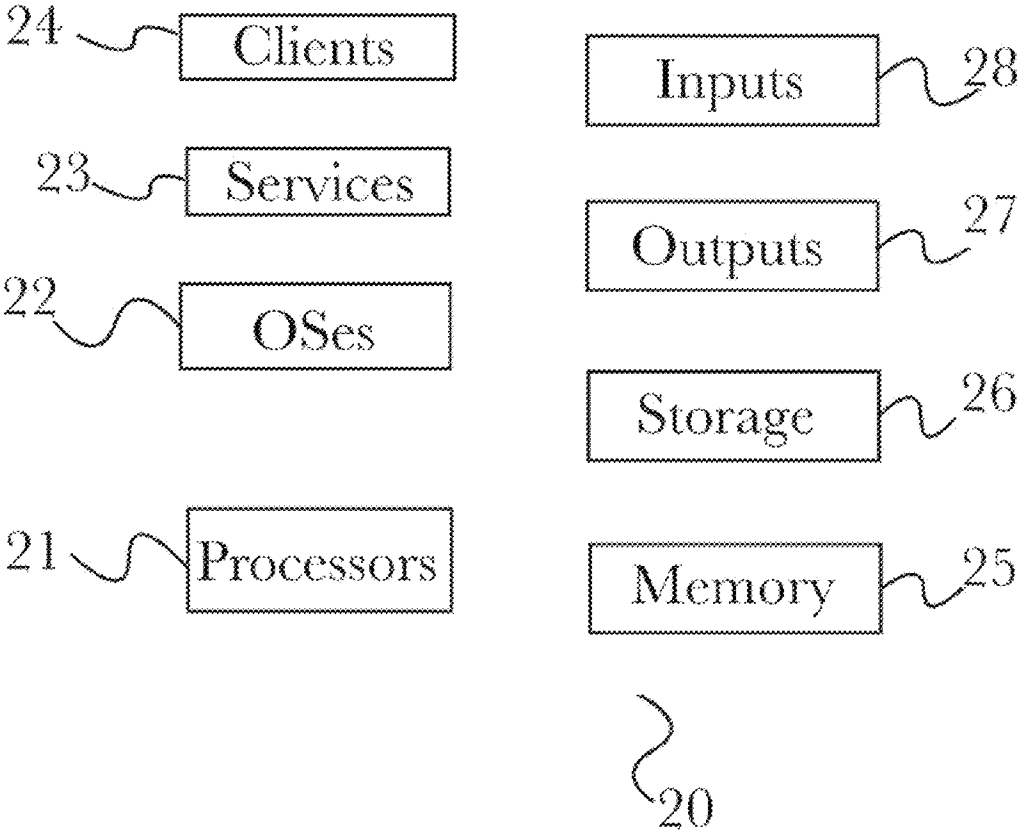
FIG. 7 depicts a diagram of an embodiment of an exemplary computing architecture that supports embodiments of the invention.

In embodiments, one or more systems may be implemented on a standalone computing system. Referring now to FIG. 7, there is depicted a diagram of an embodiment of an exemplary computing architecture, in the form of a standalone computing system, that supports embodiments of the invention. Computing device 20 comprises one or more processors 21 that may run software that carries out one or more functions or applications of embodiments, such as for example a client application 24. One or more processors 21 may carry out computing instructions under control of an operating system 22 such as, for example, a version of MICROSOFT WINDOWS™ operating system, APPLE macOS™ or iOS™ operating systems, some variety of the Linux operating system, ANDROID™ operating system, any combination thereof, and the like. In embodiments, one or more shared services 23 may be operable in system 20 and may be useful for providing common services to one or more client applications 24. Services 23 may comprise one or more WINDOWS™ services, one or more user-space common services in a Linux environment, or any other type of common service architecture used with operating system 21. One or more input devices 28 may be of any type suitable for receiving user input, including for example a keyboard, touchscreen, microphone (for example, for voice input), mouse, touchpad, trackball, or any combination thereof. One or more output devices 27 may be of any type suitable for providing output to one or more users, whether remote or local to system 20, and may comprise, for example, one or more screens for visual output, speakers, printers, or any combination thereof. Memory 25 may comprise random-access memory having any structure and architecture known in the art, for use by one or more processors 21, for example, to run software. One or more storage devices 26 may comprise any magnetic, optical, mechanical, memristor, or electrical storage device for storage of data in digital form (see, e.g., FIG. 6). Examples of storage devices 26 include flash memory, magnetic hard drive, CD-ROM, and the like.

Figure 8:
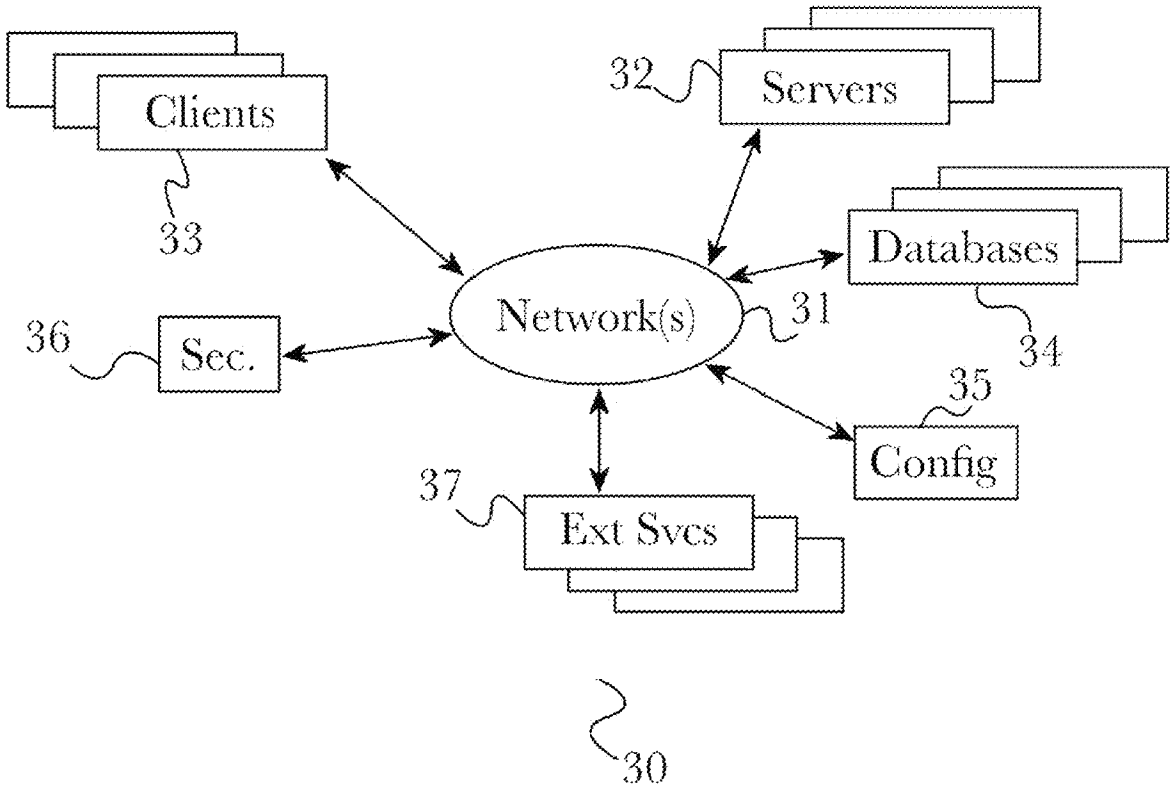
FIG. 8 depicts a diagram of several components of a computing device that supports embodiments of the invention.

In embodiments, one or more systems may be implemented on a distributed computing network, such as one having any number of clients, servers, and combinations thereof. Referring now to FIG. 8, there is shown a diagram of several components of a computing device that supports embodiments of the invention. An exemplary architecture 30 may be used to implement at least a portion of a system of one or more embodiments on a distributed computing network. According to the depicted architecture, any number of clients 33 may be provided. Each client 33 may run software for implementing client-side portions of a system; clients may comprise a system (see, e.g., FIG. 6). In addition, any number of servers 32 may be provided for handling requests received from one or more clients 33. Clients 33 and servers 32 may communicate with one another via one or more electronic networks 31, which may comprise any of an internet, a wide area network, a mobile telephony network (such as CDMA or GSM cellular networks), a wireless network (such as WiFi, WiMAX, LTE, and so forth), or a local area network (or any network topology known in the art). Networks 31 may be implemented using any suitable network protocols, including wired and wireless protocols.

In embodiments, one or more servers 32 may call one or more external services 37 when needed to obtain additional information, or to refer to additional data concerning a particular call. In embodiments, the one or more external services 37 may comprise one or more third party weather monitoring services or systems. Communications with external services 37 may take place, for example, via one or more networks 31. In embodiments, external services 37 may comprise web-enabled services or functionality related to or installed on the hardware device itself. For example, where client applications are implemented on a smartphone or other electronic device, the client applications may obtain information stored in a server system 32 in the cloud or on an external service 37 deployed on one or more of a particular enterprise's or user's premises.

In embodiments, one or more clients 33, one or more servers 32, or both, may make use of one or more specialized services or appliances that may be deployed locally or remotely across one or more networks 31. For example, one or more databases 34 may be used or referred to by one or more embodiments. In embodiments, one or more databases 34 may be arranged in any of a wide variety of architectures and may utilize any of a wide variety of data access and manipulation means. For example, in embodiments, one or more databases 34 may comprise a relational database system using a structured query language (SQL), while others may comprise an alternative data storage technology such as those referred to in the art as "NoSQL" (for example, HADOOP CASSANDRA™, GOOGLE BIGTABLE™, and so forth). In embodiments, variant database architectures such as column-oriented databases, in-memory databases, clustered databases, distributed databases, or even flat file data repositories may be used according to need or design choice. It will be appreciated by one having ordinary skill in the art that any combination of known or future database technologies may be used as appropriate, unless a specific database technology or a specific arrangement of components is specified for a particular embodiment described herein. Moreover, it should be appreciated that the term "database" as used herein may refer to a physical database machine, a cluster of machines acting as a single database system, or a logical database within an overall database management system. Unless a specific meaning is specified for a given use of the term "database", it should be construed to mean any of these senses of the word, all of which are understood as a plain meaning of the term "database" by those having ordinary skill in the art.

Similarly, in embodiments, a device or system may make use of one or more security systems 36, configuration systems 35, or both. Security and configuration management systems may comprise common information technology (IT) and web functions, and some amount of each may generally be associated with any IT or web system. It should be understood by one having ordinary skill in the art that any configuration or security subsystems known in the art now or in the future may be used in conjunction with embodiments, without limitation, unless a specific security 36 or configuration system 35 or approach is specifically required by the description of any specific embodiment.

Figure 9:
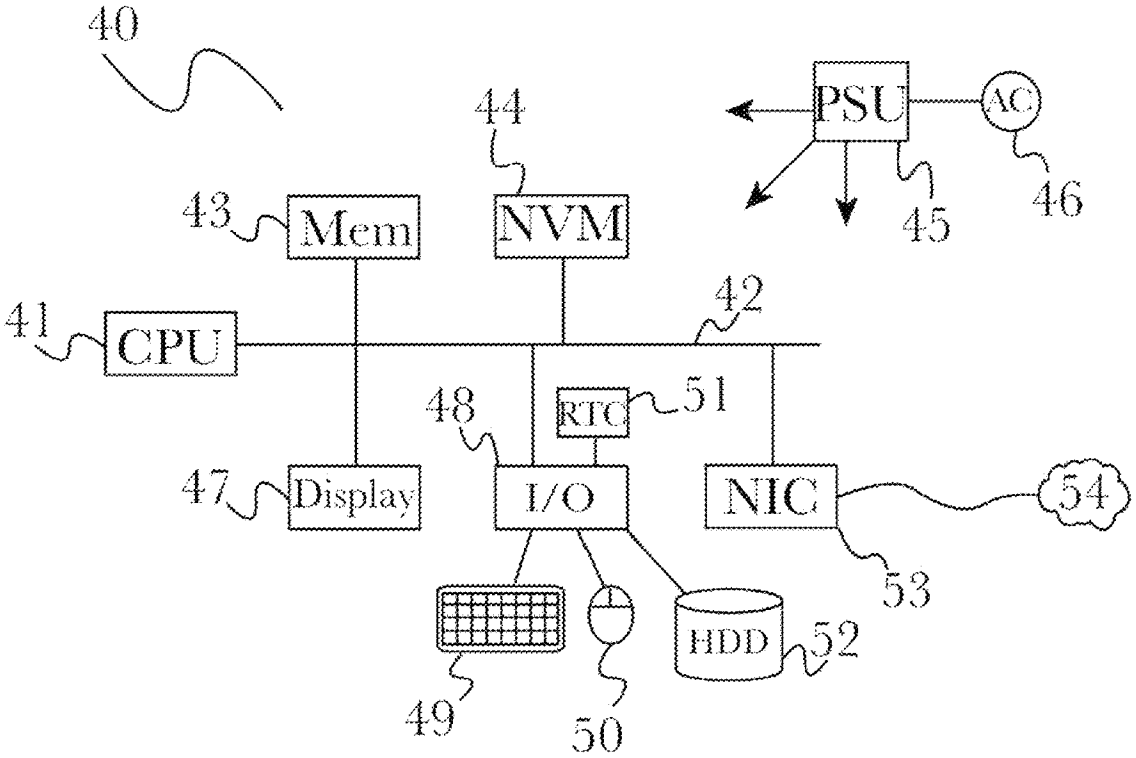
FIG. 9 depicts a diagram of several components of a computing device that supports embodiments of the invention.

Referring now to FIG. 9, there is depicted a diagram of several components of a computing device that may support embodiments of the invention. A computer system 40 may be used in any of the various locations of a system of an embodiment of the present invention. The computer system 40 is exemplary of any computer that may execute code to process data. Various modifications and changes may be made to computer system 40 without departing from the broader scope of the system and method disclosed herein. Central processing unit (CPU) 41 is connected to bus 42, which is also connected to memory 43, nonvolatile memory 44, display 47, input/output (I/O) unit 48, and network interface card (NIC) 53. In embodiments, I/O unit 48 may, typically, be connected to keyboard 49, pointing device or mouse 50, hard disk 52, and real-time clock 51. NIC 53 connects to network 54, which may be an internet (e.g., the world wide web) or a local network, which local network may or may not have one or more connections to the internet. Also shown as part of system 40 is power supply unit 45 connected, in this example, to a main alternating current (AC) supply 46. Not shown are batteries that could be present, and many other devices and modifications that are well known but are not applicable to the specific novel functions of the current system and operations disclosed herein. It should be appreciated that some or all components illustrated may be combined, such as in various integrated applications, for example, Qualcomm or Samsung system-on-a-chip (SOC) devices, or whenever it may be appropriate to combine multiple capabilities or functions into a single hardware device (for instance, in mobile devices such as smartphones, video game consoles, in-vehicle computer systems such as navigation or multimedia systems in automobiles, or other integrated hardware devices).

In embodiments, functionality for implementing systems or operations may be distributed among any number of client components, server components, or both. For example, various software modules may be implemented for performing various functions in connection with the system of any particular embodiment, and such modules may be variously implemented to run on server components, client components, or both.

In particular embodiments, the present invention provides computational operations for receiving operational data of a climate control system of a controlled climate, computing an actual run time percentage (ART) of the climate control system from the operational data, receiving temperature data of an uncontrolled climate, computing an estimated run time percentage (ERT) of the climate control system from the temperature data, and issuing an alert or warning if the ART deviates from the ERT or a range thereof. In embodiments, the computational operations are performed by one or more processors of one or more computing devices during execution of instructions encoded on one or more non-transitory computer readable storage media. In embodiments, novel and useful operations for the computation of ERT enable an accurate estimate of HVAC system run time using an adaptive learn model which adapts to a particular installation of the HVAC system.

Figure 10:
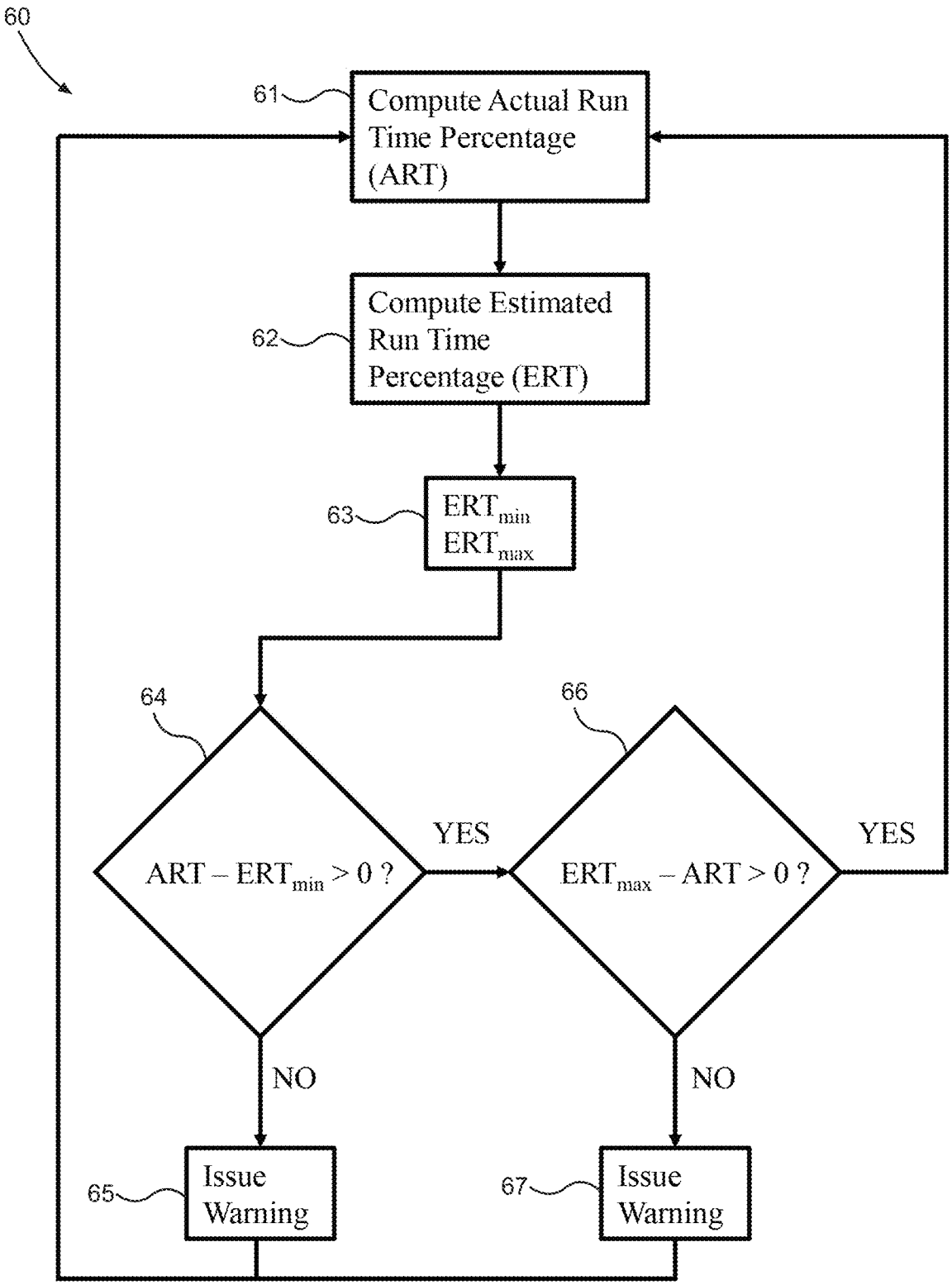
FIG. 10 depicts a flow chart of an operation of the present invention which compares actual run time percentage (ART) to estimated run time percentage (ERT) for evaluation of HVAC system operational soundness.

Referring now to FIG. 10, there is depicted a flow chart of an operation of the present invention which compares actual run time percentage (ART) to estimated run time percentage (ERT) for evaluation of HVAC system operational soundness. In embodiments, an operation 60 comprises computing actual run time percentage (ART) 61 using operational data of the HVAC system, computing estimated run time percentage (ERT) 62 using temperature data of an uncontrolled climate, and computing a range for ERT 63 having a minimum value ($ERT_{min}$) and a maximum value ($ERT_{max}$). Once the range for ERT is computed, the ART is compared with one or both limits of the ERT range to ensure that the ART is within the range.

In embodiments, $ERT_{min}$ is subtracted 64 from ART, and if the result is positive, then ART is greater than $ERT_{min}$ and is not below the ERT range. If the result is negative, then ART is less than $ERT_{min}$ and below the ERT range, which results in issuance of an alert or warning 65 before monitoring continues. In the shown embodiment $ERT_{min}$ is subtracted from ART, but a similar operation may be performed by subtracting ART from $ERT_{min}$ and determining whether the result is negative, as would be understood by the person having ordinary skill in the art. Thus, any operation which determines whether ART is less than, or less than or equal to, $ERT_{min}$, may be utilized for subtraction 64 of operation 60.

In embodiments, ART is subtracted 66 from $ERT_{max}$, and if the result is positive, then ART is less than $ERT_{max}$ and is not above the ERT range. If the result is negative, then ART is greater than $ERT_{max}$ and is above the ERT range, which results in issuance of an alert or warning 67 before monitoring continues. In the shown embodiment ART is subtracted from $ERT_{max}$, but a similar operation may be performed by subtracting $ERT_{max}$ from ART and determining whether the result is negative, as would be understood by the person having ordinary skill in the art. Thus, any operation which determines whether ART is greater than, or greater than or equal to, $ERT_{max}$, may be utilized for subtraction 66 of operation 60.

In embodiments, if ART is greater than $ERT_{min}$ and less than $ERT_{max}$ then ART is within the ERT range and no alert or warning issued for a particular instance of operation 60. In the shown embodiment, an alert or warning is issued if ART is equal to the $ERT_{min}$ or if ART is equal to the $ERT_{max}$. However, in embodiments, no alert or warning is issued if ART is equal to the $ERT_{min}$ or if ART is equal to the $ERT_{max}$ and the alert or warning is reserved for instances of operation 60 in which ART is either greater than $ERT_{max}$ or less than $ERT_{min}$.

Figure 11:
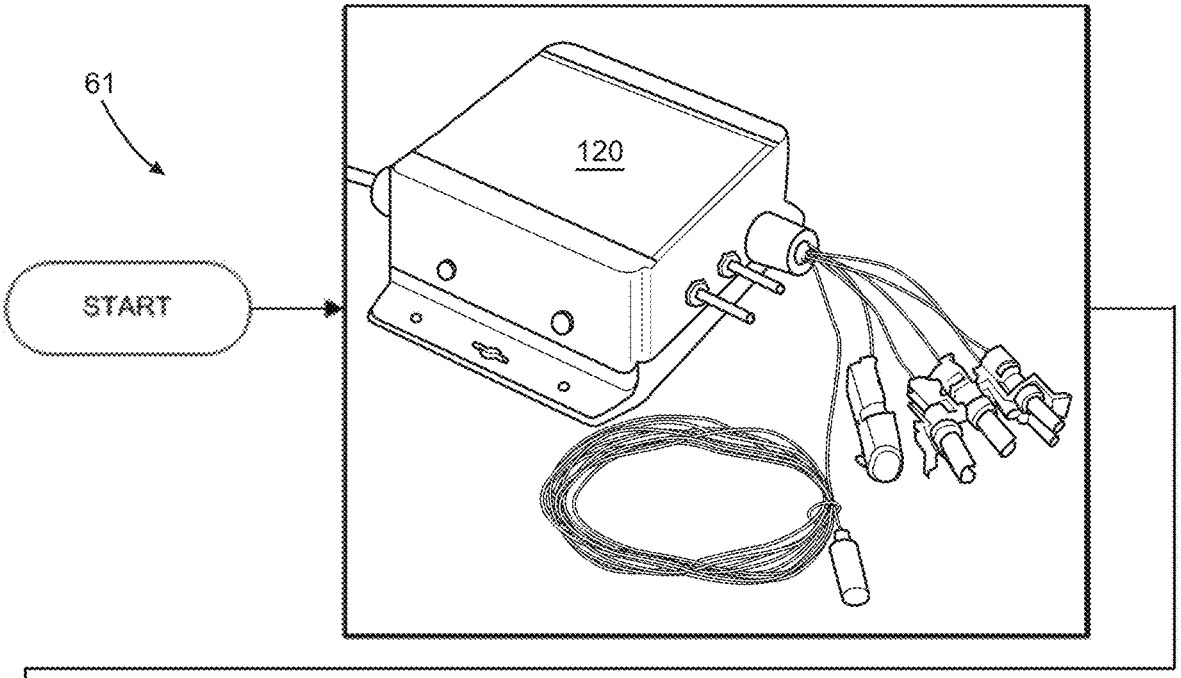
FIG. 11 depicts a flow chart of an operation of the present invention which measures and records one or more parameters of the HVAC system and computes actual run time percentage (ART).
Figure 11:
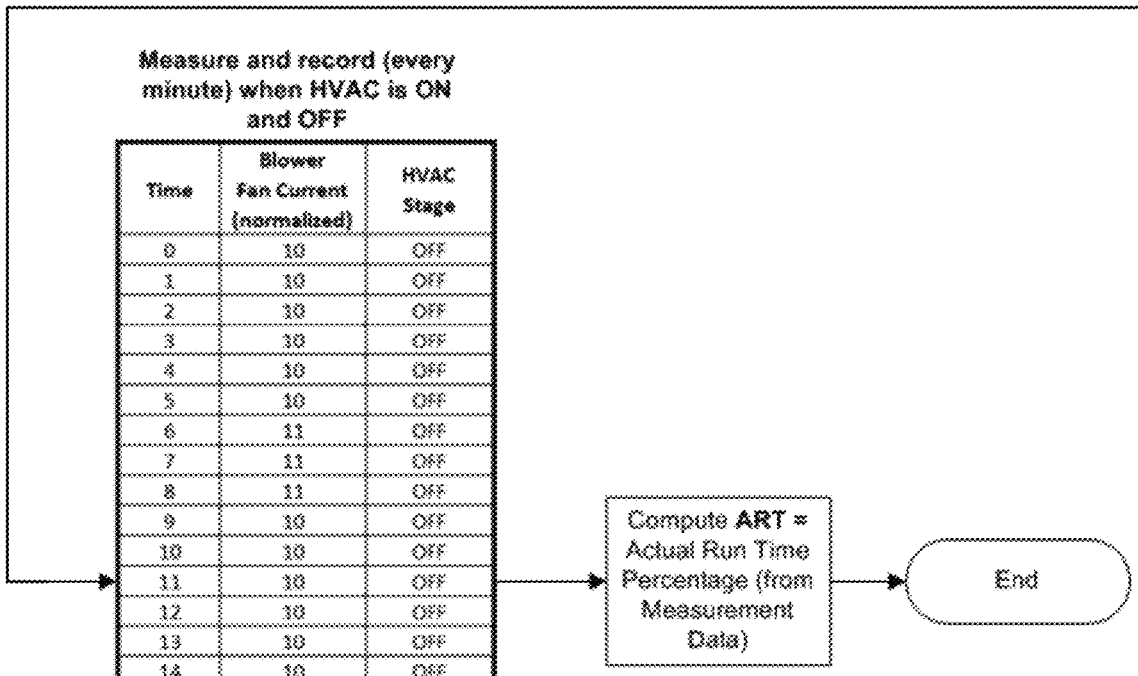

Referring now to FIG. 11, there is depicted a flow chart of an operation of the present invention which measures and records one or more parameters of the HVAC system and computes actual run time percentage (ART). In embodiments, computing ART 61 comprises receiving operational data of a climate control system, such as an HVAC system, which is installed for management of a controlled climate. In embodiments, the operational data may be obtained with a communication device 120 installed to the HVAC system, as described elsewhere herein. The communication device 120 may be a component of a monitoring system that monitors one or more parameters of the HVAC system. In embodiments, the monitored parameter may comprise one or more of an electrical current, a thermostat electrical current, a blower fan electrical current, a pressure differential across the HVAC system or a filter of the HVAC system, a temperature differential across a heat exchanger of the climate control system, and any combination thereof.

In embodiments, actual run time may be computed by summing all periods within the observation period in which the HVAC system is in an on state. In embodiments, the ART is computed by dividing the actual run time within the observation period by a length of the observation period (e.g., the full length) to produce a ratio and expressing the ratio as a percentage. In the shown embodiment, the on state is determined by analyzing normalize blower fan current data across a period of 25 minutes, and out of the 25 minutes of observation, the HVAC system is on for 7 minutes. This data would produce an actual run time of 7 minutes, and an ART equal to 100%*7/25, or 28%.

Figure 12A:
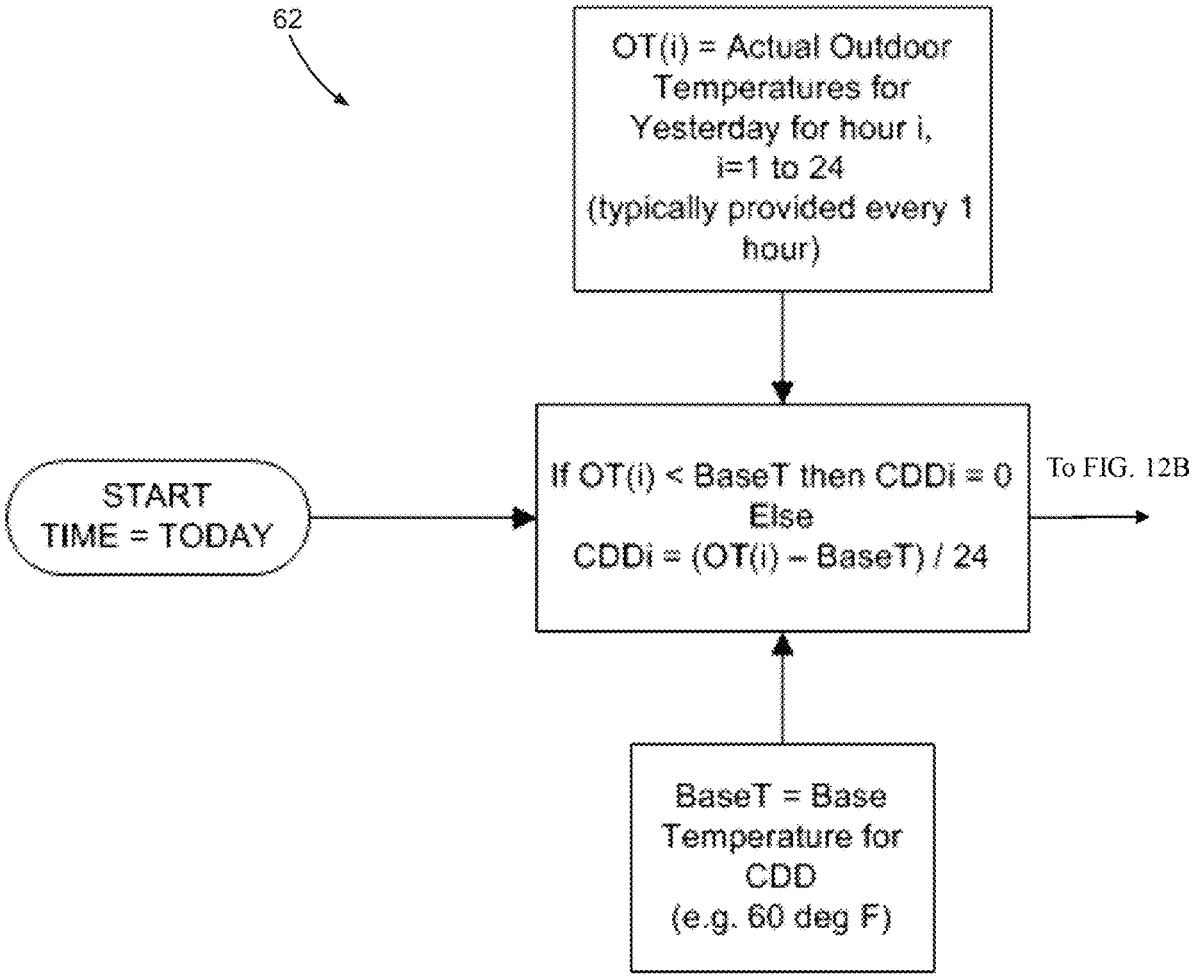
FIG. 12A depicts a flow chart of a portion of an operation of the present invention which computes one or more degree days (DD).

Referring now to FIG. 12A, there is depicted a flow chart of a portion of an operation of the present invention which computes one or more degree days (DD). In the shown embodiments, cooling degree days (CDD) are used for concise disclosure, however, the same or similar operations may be performed using heating degree days (HDD), the only difference being the type of demand (cooling or heating) and the sign of the difference between the base temperature and the degree day. Accordingly, embodiments of the present invention for computing ERT may be utilized with any HVAC system in any season.

In the shown embodiment, an operation for computing ERT 62 comprises receiving temperature data of an uncontrolled climate (e.g., the attic, the upper interior space, the proximal outdoor space, the distal outdoor space, or any combination thereof), from the communication device, from a third-party weather monitoring service or system, or both the communication device and the third-party weather monitoring service or system. In embodiments, an outdoor temperature OT(i) is the actual outdoor temperature for a portion of a previous observation period, such as an hour out of the previous day. In embodiments, OT(i) may be obtained for hour (i) where (i) may be in the range of 1 to 24, inclusive, which corresponds to hourly time points from 0:00 to 23:59 for the previous day. In embodiments, the base temperature (BaseT) for cooling degree day (CDD) may be the temperature at which the HVAC system is set such that the HVAC system maintains or attempts to maintain BaseT.

Once the OT(i) and the BaseT are available, a condition may be executed which determines how to compute a particular cooling degree day (CDDi). In the shown embodiment, if the OT(i) is less than the BaseT (i.e., no demand for cooling because it is cold outside), then CDDi is assigned to zero (0), otherwise (i.e., some demand for cooling because it is warm outside), CDDi is assigned to the difference between the BaseT and the OT(i) divided by 24 (i.e., CDDi=(OT(i)−BaseT)/24). The CDDi value is representative of demand for cooling for a particular hour (i) of the 24 hours of the previous day. As the outdoor temperature increases (OT(i) increases), the CDDi value increases as well, representing the increase in demand for cooling.

Referring now to FIG. 12B, there is depicted a flow chart of a portion of an operation of the present invention which computes estimated run time percentage (ERT) from an input DD sum value. In embodiments, the operation for computing ERT 62 comprises summing a plurality of CDD values to produce an input CDD sum value, representative of demand for cooling during the previous observation period (e.g., the previous day). In the shown embodiment, the plurality of CDD values (CDDi for each hour (i) of the previous day) are summed through one or more addition operations to produce the input CDD sum value (CDD).

After the input CDD sum value (CDD) is computed, the input CDD sum value is compared to a plurality of DD sum values; in the shown embodiment, the plurality of DD sum values reside in a calibration table of a data structure stored in one or more non-transitory computer readable storage media, but in embodiments, any alternatively structured or organized tables or data structures may be implemented without departing from the scope of the disclosure. As part of performing the comparison, the operations comprise identifying a first CDD sum value (CDD(i)) of the plurality as being less than (or less than or equal to) the input CDD sum value (CDD), wherein the first CDD sum value (CDD (i)) corresponds to a first ART value (RT(i)) and a first update number value (N) of the calibration table, as well as identifying a second CDD sum value (CDD(i+1)) of the plurality as being greater than (or greater than or equal to) the input CDD sum value (CDD), wherein the second CDD sum value (CDD(i+1)) corresponds to a second ART value (RT(i+1)) and a second update number value (M) of the calibration table. In embodiments, by performing a linear interpolation with the first CDD sum value (CDD(i)), the first ART value (RT(i)), the second CDD sum value (CDD (i+1), and the second ART value (RT(i+1)) and entering the input CDD sum value (CDD) into the linear slope formula, the ERT may be computed as follows.

$$\frac{y-y0}{x-x0}=\frac{y1-y0}{x1-x0}$$

Where x0=CDD(i), where y0=RT(i), where x1=CDD(i+1), where y1=RT(i+1), and where x=CDD.

After rearranging, the equation may appear as follows:

$$y = (y1 - y0) * \frac{x - x0}{x1 - x0}$$

Or, alternatively, the equation may appear as follows:

$$ERT = (RT(i+1) - RT(i)) * \frac{CDD - CDD(i)}{CDD(i+1) - CDD(i)}$$

Figure 12C:
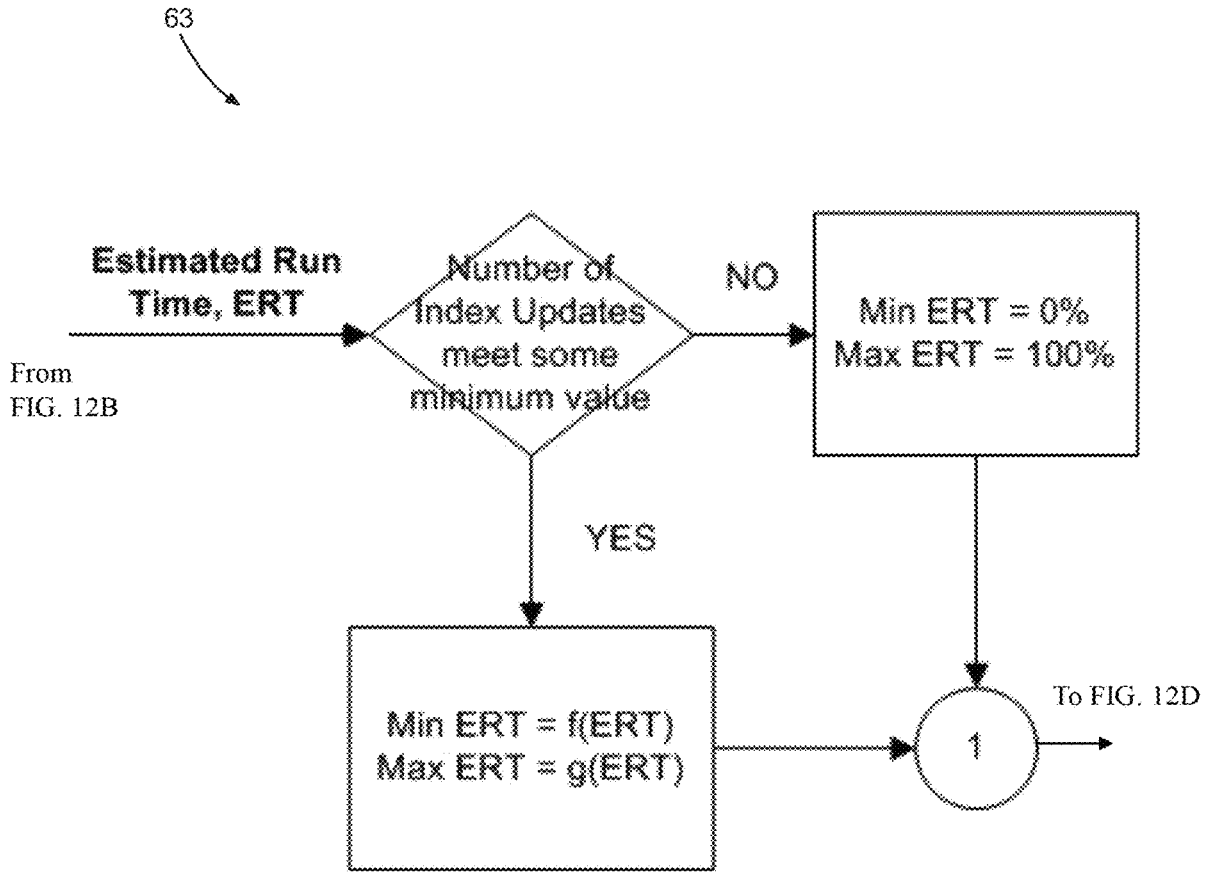
FIG. 12C depicts a flow chart of a portion of an operation of the present invention which computes a range defined by a minimum ERT and a maximum ERT.

Referring now to FIG. 12C, there is depicted a flow chart of a portion of an operation of the present invention which computes a range defined by a minimum ERT and a maximum ERT. In embodiments, computing a range for ERT 63 having a minimum value ($ERT_{min}$) and a maximum value ($ERT_{max}$) comprises executing instructions for comparing an update threshold (i.e., some minimum value) to each of the first update number value (N of FIG. 12B) and the second update number value (M of FIG. 12B). This comparison may be necessary to ensure that only data which has been previously updated is used for computing the ERT range, which may improve accuracy of the adaptive model.

In embodiments, if each of the first update number value and the second update number value is greater than (or equal to or greater than) the update threshold, then the computed ERT value from the linear interpolation (see FIG. 12B) may be used as an input for one or more functions for computing $ERT_{min}$ (minimum ERT or Min ERT) and $ERT_{max}$ (maximum ERT or Max ERT), e.g., by executing some first function f(ERT) and some second function g(ERT), respectively. In embodiments, the first and second functions may be comprised of one or more suitable operations for computing limits that define the ERT range. In an exemplary embodiment, each of these functions may multiply the ERT with some constant value to compute the corresponding limit; as a non-limiting example, f(ERT)=0.5*ERT and g(ERT)=1.5*ERT. In such an embodiment, the resultant range for ERT would span from 50% to 150% of the computed ERT value. As would be understood by the person having ordinary skill in the art, the choice or design of one or more functions for computing the range limits $ERT_{min}$ and $ERT_{max}$ may vary according to a particular embodiment. If the adaptive learn model must be more sensitive to changes in the ART, then a smaller ERT range may be implemented, which may result in a greater number of alerts or warnings issued by the device or system. If the adaptive learn model must be less sensitive to changes in the ART, then a larger ERT range may be implemented, which may result in a lesser number of alerts or warnings issued by the device or system. Adjustment of the ERT range may be performed automatically, programmatically, or manually (e.g., by a technician), as needed.

In embodiments, if each of the first update number value and the second update number value is not greater than (or equal to or greater than) the update threshold, then the $ERT_{min}$ may be assigned to be 0% and the $ERT_{max}$ may be assigned to be 100%, which effectively eliminates the use of a range for ERT and causes subsequent operations to evaluate any ART as being acceptable and within range of the ERT, thereby preventing the issuance of a warning or alert based on this data point. This may improve the accuracy of the adaptive learn model because false positive alerts or warnings may otherwise occur, especially during times of changing weather or changing demand. For example, if demand for cooling increases with the onset of summer and the input CDD sum value (see FIG. 12B) increases to reach lower rows in the calibration table which have not been sufficiently updated in previous iterations, then the data of those rows may not be indicative of expected performance, and as such, it would not be appropriate to construct ERT limits using the data of these rows. In such an instance of this operation, the operations may evaluate any ART as being "within range" (within the range of 0% to 100%) to prevent false positive alerts or warnings from being issued. In this manner, the adaptive learn model may adapt itself to the changing data without warning or alerting individuals unless necessary.

Figure 12D:
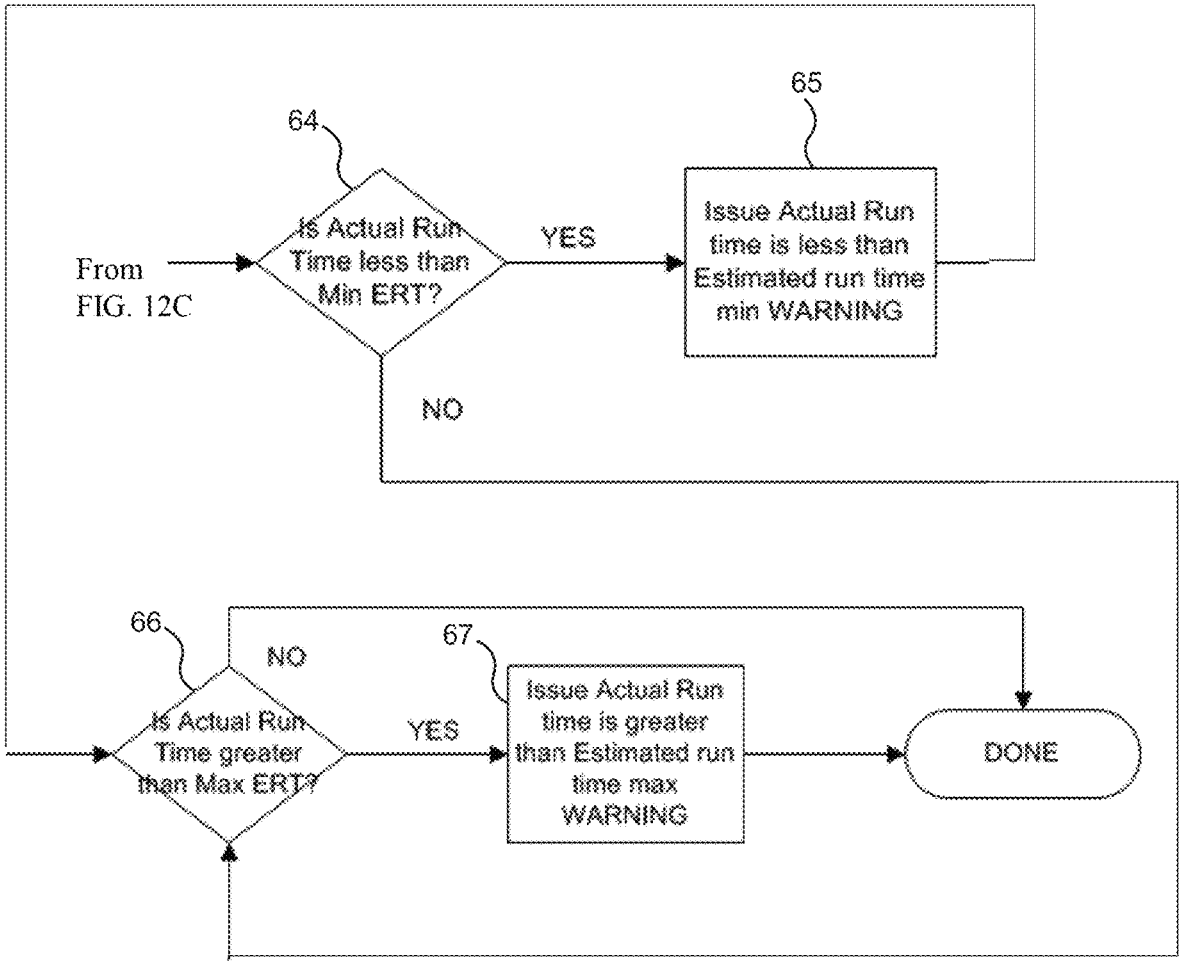
FIG. 12D depicts a flow chart of a portion of an operation of the present invention which compares the ART with the range defined by the minimum ERT and the maximum ERT, and issues one or more alerts if the ART is outside the range.

Referring now to FIG. 12D, there is depicted a flow chart of a portion of an operation of the present invention which compares the ART with the range defined by the minimum ERT and the maximum ERT, and issues one or more alerts if the ART is outside the range. In embodiments, comparing the ART to the minimum ERT (Min ERT) 64 may involve one or more subtraction operations, such as subtracting the $ERT_{min}$ from the ART and if the resultant value is positive then the ART is not less than the $ERT_{min}$ (NO), while if the resultant value is negative then the ART is less than the $ERT_{min}$ (YES) and an alert or warning is issued 65. As would be understood by the person having ordinary skill in the art, a related operation may comprise subtracting the ART from the $ERT_{min}$ and determining whether the resultant value is negative or positive. In embodiments, comparing the ART to the maximum ERT (Max ERT) 66 may involve one or more subtraction operations, such as subtracting the ART from the $ERT_{max}$ and if the resultant value is positive then the ART is not greater than the $ERT_{max}$ (NO), while if the resultant value is negative then the ART is greater than the $ERT_{max}$ (YES) and an alert or warning is issued 67. As would be understood by the person having ordinary skill in the art, a related operation may comprise subtracting the $ERT_{max}$ from the ART and determining whether the resultant value is negative or positive.

Figure 13A:
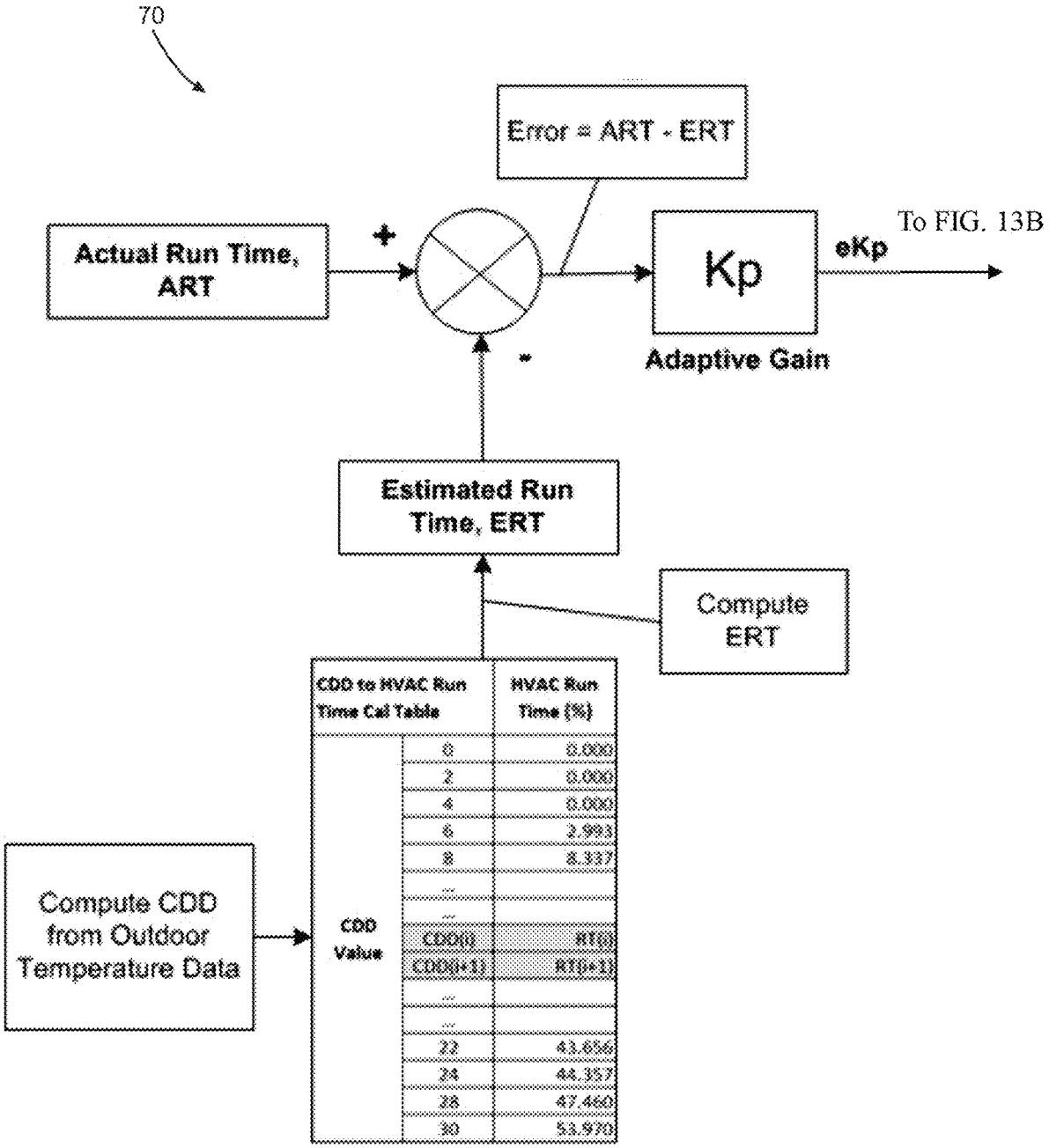
FIG. 13A depicts a flow chart of a portion of an operation of the present invention which computes an error value by subtracting the ERT from the ART and computes an adjusted error value by multiplying the error value by an adaptive gain value.

Referring now to FIG. 13A, there is depicted a flow chart of a portion of an operation of the present invention which computes an error value by subtracting the ERT from the ART and computes an adjusted error value by multiplying the error value by an adaptive gain value. In embodiments, the operations further comprise one or more calibration table operations 70 for creating or updating a data structure comprising a calibration table, which may be performed regularly (e.g., daily). In embodiments, the calibration table comprises: a first column comprising a plurality of degree day (DD) sum values, such as cooling degree day (CDD) values; a second column comprising a plurality of ART values; and a third column comprising a plurality of update number values, such that if an ART value of the second column is updated, a corresponding update number value of the third column is incremented.

Generally, the calibration table is only updated if the HVAC system is in a known good operational state. Because operational data obtained from an HVAC system running in a poor operational state may bias the adaptive learn model and possibly prevent the detection of problems with the HVAC system, this data should not be utilized when updating the calibration table. Accordingly, operations 70 may only occur if the HVAC system is operating soundly and if no warnings or alerts are issued.

The calibration table, which contains data that is specific to an HVAC installation at a particular location, is critical for maintaining accuracy of the ERT calculation. Accordingly, in embodiments, the operations further comprise updating the calibration table by computing an error value by subtracting the ERT from the ART (Error=ART−ERT) and computing an adjusted error value (eKp) by multiplying the error value (Error) by an adaptive gain value (Kp). The adaptive gain value (Kp) may critically impact how the calibration table is updated; too small of a value for Kp will result in the calibration table being updated slowly, and too large of a value for Kp will result in the calibration table being updated too quickly and individual values may change very significantly from day to day.

Experimentation with different values for Kp has yielded the following values: a) if the cells have never been updated before (e.g., they are identically zero) then the value of Kp may be within a range defined by 0.7 to 0.9, inclusive; b) if the cells have been updated before (e.g., they are non-zero) then the value of Kp may be within a range defined by 0.25 to 0.5, inclusive. Thus, in embodiments, the value utilized for the adaptive gain value (Kp) may range from 0.25 to 0.9, inclusive, depending on the calibration table.

Figure 13B:
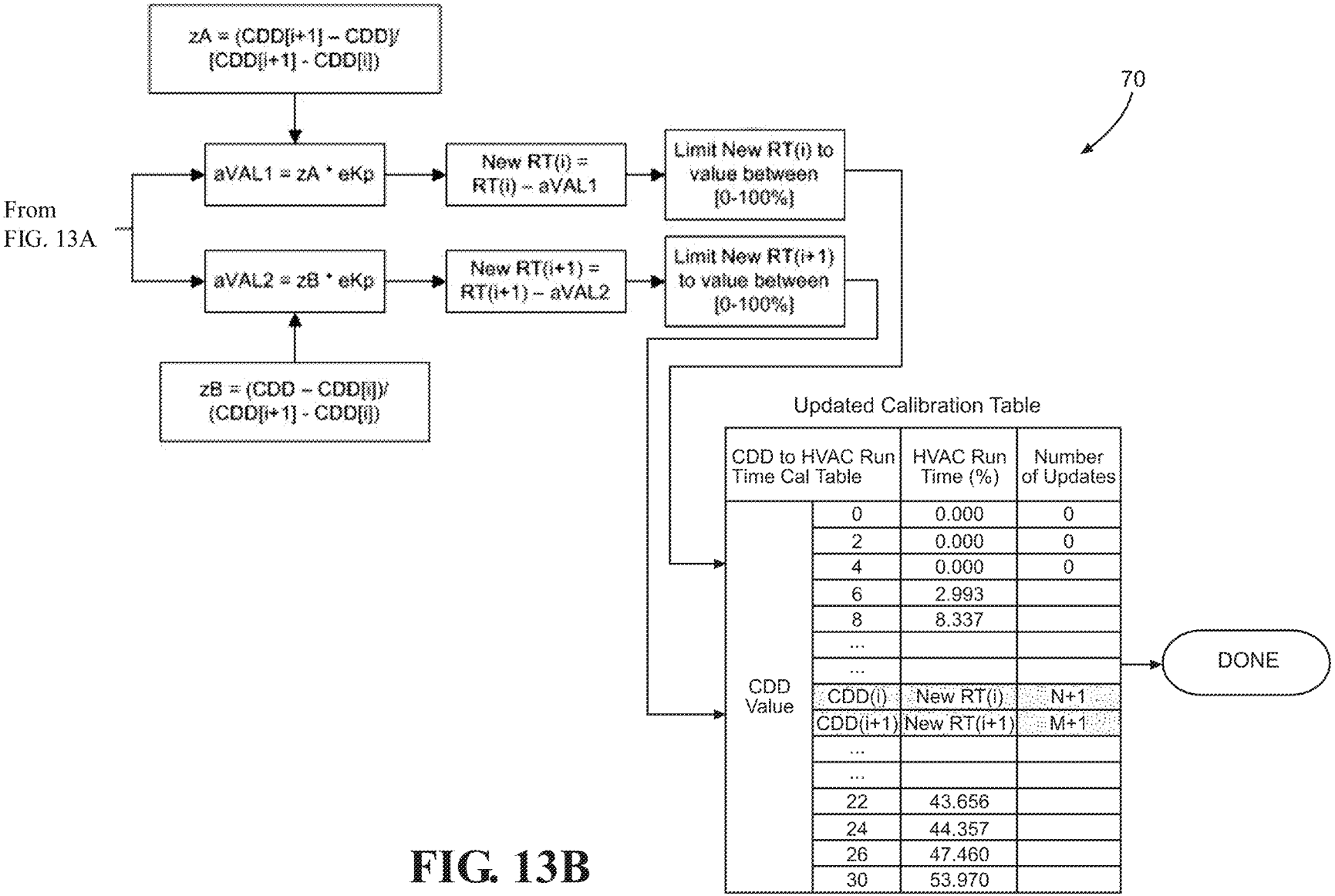
FIG. 13B depicts a flow chart of a portion of an operation of the present invention which computes values for updating a calibration table of a data structure of the present invention.

Referring now to FIG. 13B, there is depicted a flow chart of a portion of an operation of the present invention which computes values for updating a calibration table of a data structure of the present invention. After the adjusted error value (eKp) is computed, new run time (ART) values are computed to replace old run time (ART) values in the calibration table. In embodiments, the new ART values may be computed utilizing one or more algebraic operations such as linear interpolation. In embodiments, calibration table operations 70 comprise computing a first new ART value (New RT(i) of FIG. 13B) to replace a first old ART value (RT(i) of FIG. 13A) and computing a second new ART value (New RT(i+1) of FIG. 13B) to replace a second old ART value (RT(i+1) of FIG. 13A). In embodiments, the first new ART value (New RT(i) of FIG. 13B) is computed by subtracting a first computed value (aVAL1) from the first old ART value (RT(i) of FIG. 13A) and the second new ART value (New RT(i+1) of FIG. 13B) is computed by subtracting a second computed value (aVAL2) from the second old ART value (RT(i+1) of FIG. 13A). In embodiments, the first and second computed values (aVAL1 and aVAL2, respectively) represent some amount which the HVAC Run Time (%) of the calibration table needs to be adjusted.

In embodiments, the first computed value (aVAL1) is computed by multiplying a first ratio value (zA) by the adjusted error value (eKp), and the second computed value (aVAL2) is computed by multiplying a second ratio value (zB) by the adjusted error value (eKp). Any values may be utilized for zA and zB, however, values obtained from linear interpolation may improve accuracy of the calibration table. Accordingly, in embodiments, the first ratio value (zA) is computed by subtracting the input DD sum value (e.g., CDD) from the second DD sum value (e.g., CDD(i+1)) to produce a first numerator value, subtracting the first DD sum value (e.g., CDD(i)) from the second DD sum value (e.g., CDD(i+1)) to produce a first denominator value, and dividing the first numerator value by the first denominator value to produce the first ratio value (zA). The second ratio value (zB) may be computed by subtracting the first DD sum value (e.g., CDD(i)) from the input DD sum value (e.g., CDD) to produce a second numerator value, subtracting the first DD sum value (e.g., CDD(i)) from the second DD sum value (e.g., CDD(i+1)) to produce a second denominator value, and dividing the second numerator value by the second denominator value to produce the second ratio value (zB). In embodiments, after computing the new ART values (i.e., New RT(i) and New RT(i+1)), the ERT limits (i.e., $ERT_{min}$ and $ERT_{max}$) are assigned to be 0% and 100%, respectively, and in this manner, the issuance of a warning or alert may be suppressed during updating of the calibration table according to operations 70.

In embodiments, operations 70 further comprise computing an input DD sum value (e.g., CDD), representative of demand for heating or cooling during a previous observation period, comparing the input DD sum value to the plurality of DD sum values of the calibration table, identifying a first DD sum value (e.g., CDD(i)) of the plurality as being less than the input DD sum value, wherein the first DD sum value corresponds to the first old ART value (e.g., RT(i)) and a first update number value of the plurality of update number values, identifying a second DD sum value (e.g., CDD(i+1)) of the plurality as being greater than the input DD sum value, wherein the second DD sum value corresponds to the second old ART value (e.g., RT(i+1)) and a second update number value of the plurality of update number values.

Referring now to FIG. 13C, there is depicted an exemplary update to a calibration table of a data structure of the present invention which includes original data, updated data, and the difference therebetween. In the shown embodiment, values of the calibration table are shown in original and updated forms, and the difference (Delta) is also depicted. In the shown embodiment, two rows have been updated: CDD=10 and CDD=12. The row for CDD=10 has had the HVAC Run Time % changed from 15.397 to 15.455, and the row for CDD=12 has had the HVAC Run Time % changed from 19.465 to 19.962. In embodiments, such an update may occur because of calibration table operations (e.g., 70 of FIG. 13A and FIG. 13B). By updating the calibration table, the adaptive learn model adapts to changing data throughout a period with minimal manual input or human-based corrective actions, e.g., from HVAC system technicians or specialists.

Figure 14:
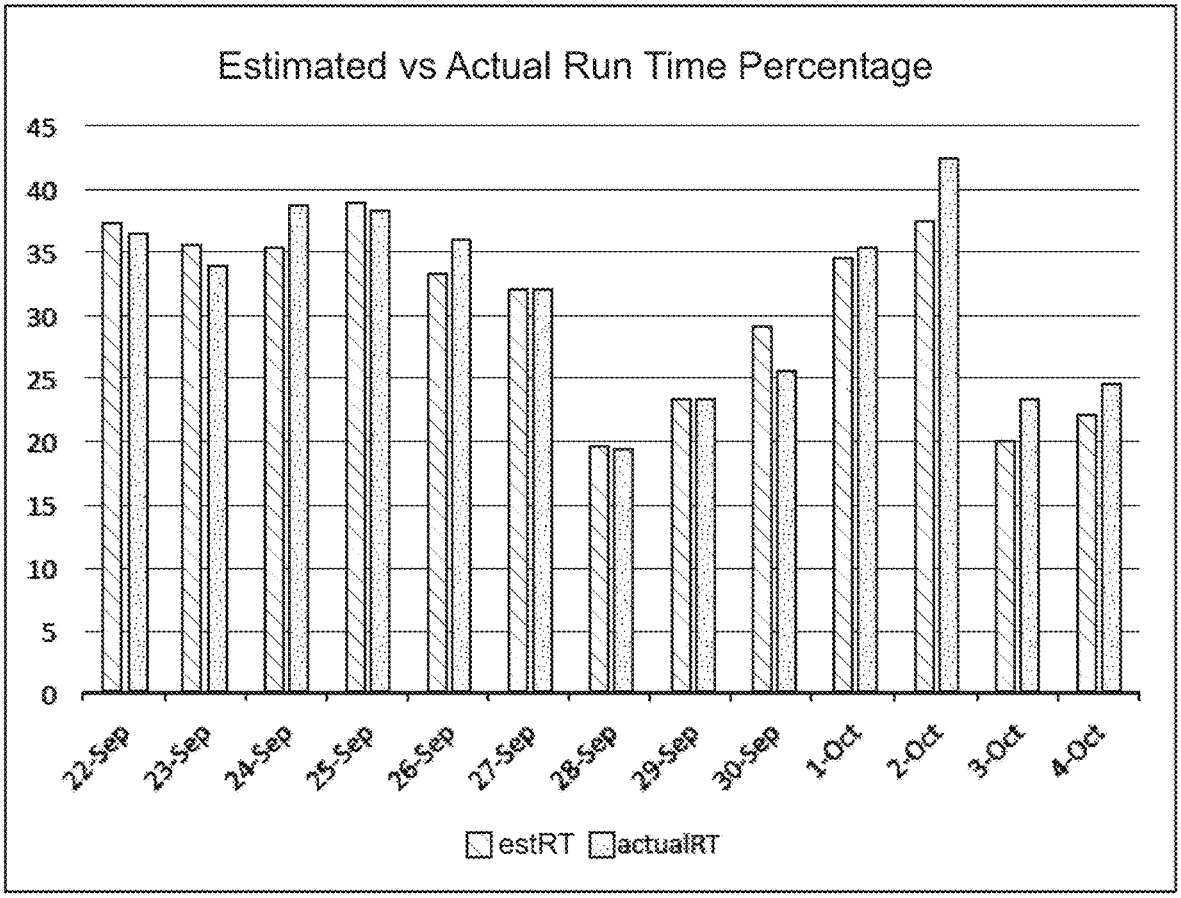
FIG. 14 depicts a bar chart comparing estimated run time percentage (ERT) values to actual run time percentage (ART) values over a period of 13 days.

Referring now to FIG. 14, there is depicted a bar chart comparing estimated run time percentage (ERT) values to actual run time percentage (ART) values over a period of 13 days. As evidenced by these results, obtained from an exemplary installation of a monitoring system of the present invention, the ART was accurately estimated by operations for computing ERT as disclosed herein. Accordingly, operations of the present invention are very valuable for monitoring climate control systems, such as HVAC systems, as part of efforts to identify problems with these systems before continued degradation and before complete failure.

Referring now to FIG. 15A and FIG. 15B, there is depicted an exemplary calibration table of a data structure of the present invention, which is divided into days of the week. If an HVAC system is subjected to different user set points (base temperatures), alternate calibration table structures may provide improved results for estimating HVAC system run time percentage. For example, in embodiments, the base temperature may differ depending on the day of the week, and a calibration table which only updates as a function of the day of the week may be better able to track this usage pattern and provide improved performance of the adaptive learn model.

Referring now to FIG. 15C and FIG. 15D, there is depicted an exemplary calibration table of a data structure of the present invention, which is divided into hours of the day. In embodiments, an HVAC system may be positioned in an attic of a structure rather than a basement or closet, and a monitoring system of the present invention may comprise a box thermometer which provides a direct measurement of the attic temperature, which may be utilized in addition to or instead of an outdoor temperature. In embodiments, the calibration table may comprise one or more additional features for linking the time of day with the average attic temperature for a given observation period. In embodiments, the calibration table may comprise data that is divided into hours of the day for finer granularity of the data. Regardless of the level of detail or granularity of the calibration table data, the same or similar principles and operations for creating, maintaining, and updating the calibration table, as described elsewhere herein, may be implemented in a particular embodiment.

Referring now to FIG. 16A, there is depicted an exemplary calibration table with columns showing ART values before and after an adjustment to increase a local minimum value to an average of two or more adjacent ART values. Generally, as the computed DD (e.g., CDD or HDD) value increases, the ART value should also increase to reflect the increased demand for heating or cooling. These adjustments to the one or more calibration tables may be made regularly, e.g., periodically, but may be made less frequently than the regular calibration table update. In embodiments, if the regular calibration table update occurs daily, then these adjustments may occur weekly. In embodiments, if a local minimum value exists in the calibration table (e.g., the row having CDD=16 and the row having CDD=24), these local minima may be updated to be the average of two or more adjacent values. In the shown embodiment, 30.085 is the average of 27.131 and 33.038, and is the updated value for the row having CDD=16, and 44.737 is the average of 42.087 and 47.387, and is the updated value for the row having CDD=24. By smoothing the data in the calibration table, the ERT may better approximate the ART and the adaptive learn model may be more accurate.

Referring now to FIG. 16B, there is depicted an exemplary calibration table with columns showing ART values before and after an adjustment to assign a maximum ART value to a plurality of higher input DD sum values. If, after an extended number of adaptive updates to the calibration table(s), there are high values for the DD (e.g., CDD or HDD) that have never been reached during use of the HVAC system, these high values should be assigned to be the maximum DD (e.g., CDD or HDD) value. For example, in the shown embodiment, the CDD value having the maximum HVAC Run Time % (59.980) is CDD=28, which is used to update rows for CDD=32 to CDD=50. In this manner, if these higher CDD values are reached during computation of ERT, the computed ERT may better approximate the ART despite such usage not being directly observed previously by the adaptive learn model.

Figure 17A:
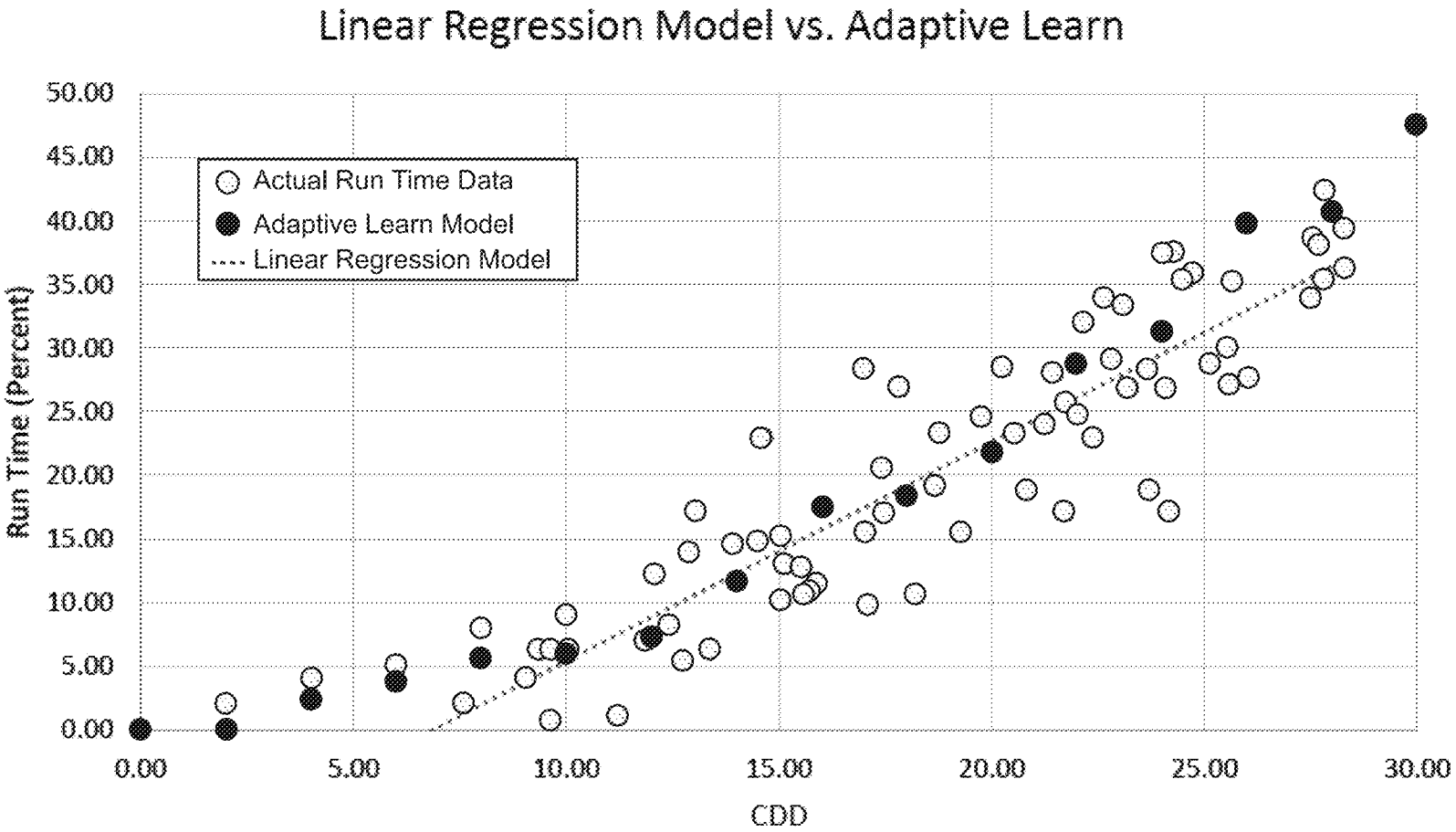
FIG. 17A depicts a scatter plot comparing performance of a linear regression model to performance of an adaptive learn model of the present invention.

Referring now to FIG. 17A, there is depicted a scatter plot comparing performance of a linear regression model to performance of an adaptive learn model of the present invention. If a significant portion of the ART data is in a particular range, e.g., from 10% to 30% as in the figure, a linear regression model would fail to effectively fit the data, because each data point is weighted equally in the linear regression model. For example, for values of CDD<7, the linear regression model incorrectly predicts that the run time percentage will be less than zero; even with adjustments to the linear regression model, these data points would still be poorly predicted (e.g., if negative data were assigned a value of zero, this would still be an ineffective model for estimating run time percentage). Even if a polynomial were to be applied to the data, the shortcomings of the linear regression model would not be overcome. On the contrary, the adaptive learn model accurately and precisely predicts the run time percentage with minimal error.

Figure 17B:
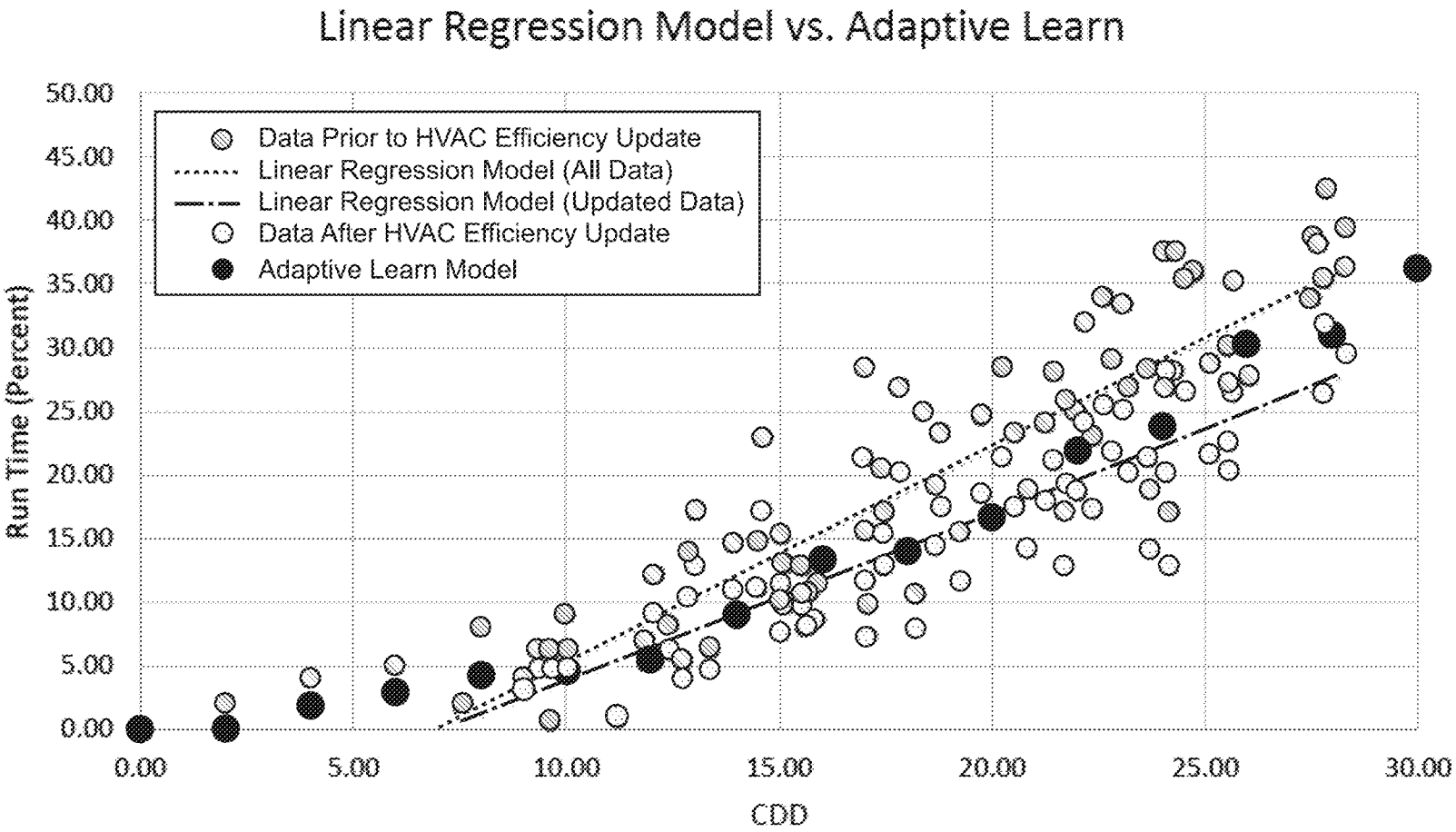
FIG. 17B depicts a scatter plot comparing performance of a linear regression model—before and after an efficiency update to the HVAC system—to performance of an adaptive learn model of the present invention.

Referring now to FIG. 17B, there is depicted a scatter plot comparing performance of a linear regression model—before and after an efficiency update to the HVAC system—to performance of an adaptive learn model of the present invention. If the controlled climate undergoes some change, such as installation of additional insulation, a radiant barrier, HVAC system maintenance, or any combination thereof, the thermal efficiency of the structure may be improved and operational efficiency of the HVAC system may also be improved. In the shown embodiment, HVAC system efficiency improvement results in a decrease of the run time by 25%. Because a large proportion of the available HVAC system operational data was capture prior to the efficiency update, the linear regression model (all data) provides a poor fit for the data. Even if the linear regression model only considered data after the update (updated data), this would still be a poor fit, at least for the reasons described for FIG. 17A. Because the adaptive learn model of the present invention automatically updates to reflect this change in the data (e.g., within one to two months after the efficiency update), with no intervention, it provides a superior, highly accurate and precise approach for estimation of HVAC system run time.

Figure 17C:
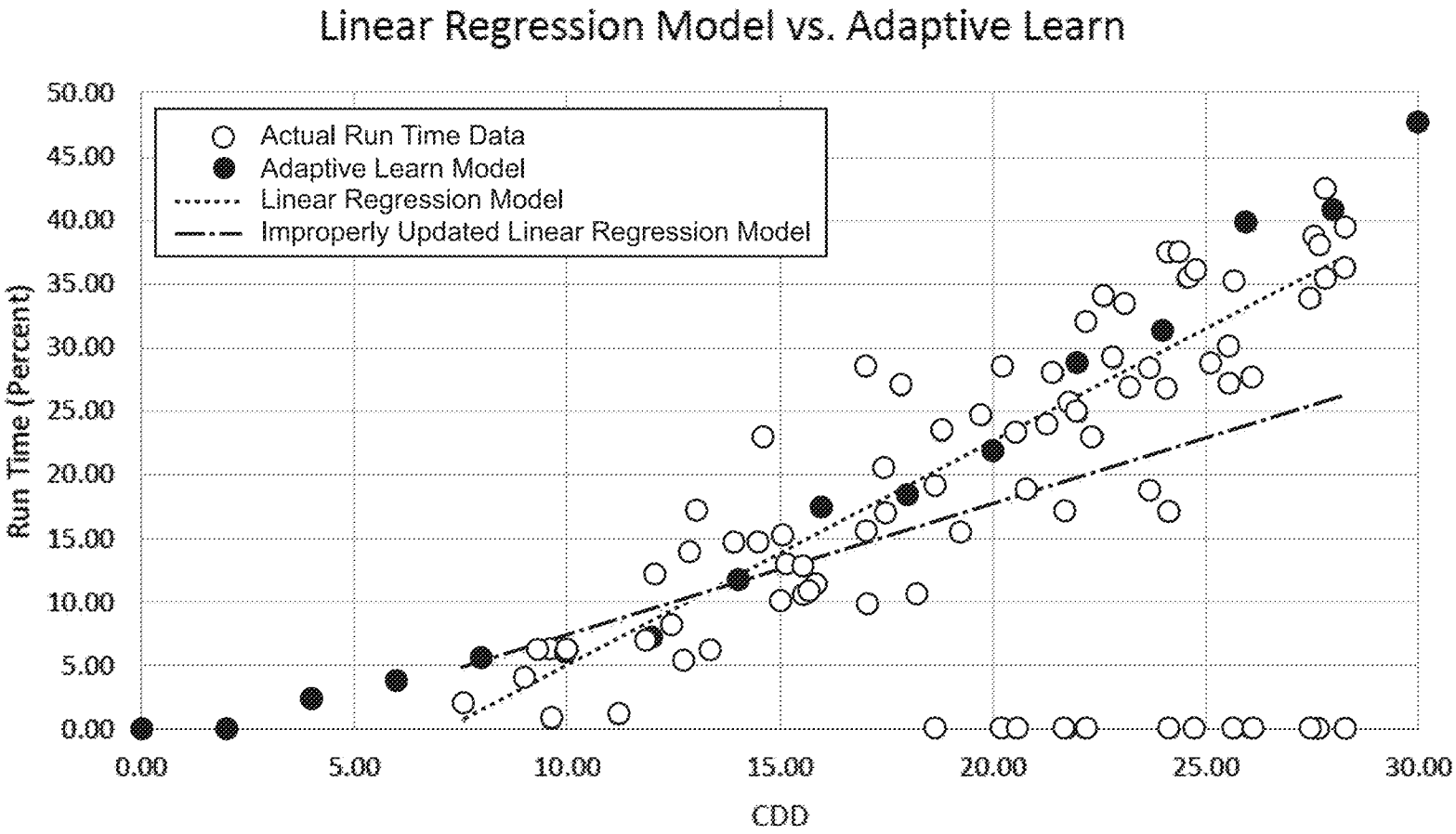
FIG. 17C depicts a scatter plot comparing performance of a linear regression model—before and after an improper update to the linear regression model—to performance of an adaptive learn model of the present invention.

Referring now to FIG. 17C, there is depicted a scatter plot comparing performance of a linear regression model—before and after an improper update to the linear regression model—to performance of an adaptive learn model of the present invention. Because the adaptive learn model of the present invention only "learns" or updates if it is determined that the HVAC system is operating properly and without issue, the adaptive learn model does not incorporate HVAC system run time data obtained during faulty operation or if there is some issue with the HVAC system. On the contrary, approaches that involve linear regression may incorporate run time data even if the HVAC system is operating in a degraded state. In the shown embodiment, linear regression to estimate HVAC system run time may be improperly updated to include degraded run time data, which skews or biases the linear regression model toward this data. In the shown embodiment, the HVAC system operated at zero run time percent (0%) for a number of data points, and by considering these data during construction of the linear regression model, the resulting linear regression model was biased toward this faulty data (Improperly Updated Linear Regression Model). Even if the faulty data is excluded from linear regression model construction (Linear Regression Model), this would still be a poor fit, at least for the reasons described for FIG. 17A. For at least these reasons, the adaptive learn model is superior, more accurate, and more precise compared to approaches that rely on regression approaches, such as linear regression models.

As used herein, any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive "or" and not to an exclusive "or." For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs for embodiments of the present invention. Thus, while particular embodiments and applications have been illustrated and described, it is to be understood that the disclosed embodiments are not limited to the precise construction and components disclosed herein.

Various apparent modifications, changes and variations may be made in the arrangement, operation and details of the method and apparatus disclosed herein without departing from the spirit and scope defined in the appended claims.

Headings of sections provided in this patent application and the title of this patent application are for convenience only and are not to be taken as limiting the disclosure in any way.

Devices that are in communication with each other need not be in continuous communication with each other, unless expressly specified otherwise. In addition, devices that are in communication with each other may communicate directly or indirectly through one or more communication means or intermediaries, logical or physical.

A description of an embodiment with several components in communication with each other does not imply that all such components are required. To the contrary, a variety of optional components may be described to illustrate a wide variety of possible embodiments and to illustrate one or more embodiments more fully. Similarly, although process steps, method steps, algorithms and the like may be described in a sequential order, such processes, methods, and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the embodiments, and does not imply that the illustrated process is preferred. Also, steps are generally described once, but this does not mean they must occur once, or that they may only occur once each time a process, method, or algorithm is carried out or executed. Some steps may be omitted in embodiments, or some steps may be executed more than once in embodiments.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Process descriptions or blocks in figures should be understood as representing modules, segments, or portions of code which include one or more executable instructions for implementing specific logical functions or steps in the process. Alternate implementations are included within the scope of various embodiments in which, for example, functions may be executed out of order from that shown or discussed, including substantially concurrently or in reverse order, depending on the functionality involved, as would be understood by a person having ordinary skill in the art.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the present invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

I claim:

1. A computer program product, comprising a non-transitory computer readable storage medium having instructions encoded thereon that, when executed by a processor, cause the processor to perform operations comprising:

receiving operational data of a climate control system of a controlled climate;

computing an actual run time percentage (ART) of the climate control system from the operational data;

receiving temperature data of an uncontrolled climate;

computing an estimated run time percentage (ERT) of the climate control system from the temperature data, wherein the ERT is computed by:

computing an input degree day (DD) sum value, representative of demand for heating or cooling during a previous observation period;

linearly interpolating a first DD sum value, a first ART value, a second DD sum value, and a second ART value to produce a linear slope formula; and entering the input DD sum value into the linear slope formula to compute the ERT; and issuing an alert if the ART deviates from the ERT or a range thereof, wherein the alert is to notify an individual about a problem of the climate control system to facilitate repair of the climate control system before the climate control system fails.

2. The computer program product of claim 1, wherein the operational data is received from a monitoring system that monitors a parameter of the climate control system.

3. The computer program product of claim 2, wherein the parameter comprises an electrical current of the climate control system.

4. The computer program product of claim 3, wherein the electrical current is measured at a thermostat or a blower fan of the climate control system.

5. The computer program product of claim 2, wherein the parameter comprises a pressure differential across the climate control system.

6. The computer program product of claim 2, wherein the parameter comprises a temperature differential across a heat exchanger of the climate control system.

7. The computer program product of claim 1, wherein the ART is computed by dividing an actual run time within an observation period by a length of the observation period to produce a ratio and expressing the ratio as a percentage.

8. The computer program product of claim 1, wherein the temperature data of the uncontrolled climate originates from a measurement of a temperature sensor positioned external to the controlled climate during a previous observation period.

9. The computer program product of claim 1, wherein the ERT is further computed by:

computing a plurality of degree day (DD) values from a base temperature (BT) and a plurality of temperatures of the temperature data measured during the previous observation period;

summing the plurality of DD values to produce the input DD sum value, representative of demand for heating or cooling during the previous observation period;

comparing the input DD sum value to a plurality of DD sum values;

identifying the first DD sum value of the plurality as being less than the input DD sum value, wherein the first DD sum value corresponds to the first ART value and a first update number value; and identifying the second DD sum value of the plurality as being greater than the input DD sum value, wherein the second DD sum value corresponds to the second ART value and a second update number value.

10. The computer program product of claim 9, wherein the first and second update number values are greater than an update threshold; wherein a minimum of the range of the ERT is computed by a first function; wherein a maximum of the range of the ERT is computed by a second function.

11. The computer program product of claim 9, wherein the first and second update number values are less than an update threshold; wherein a minimum of the range of the ERT is assigned to be 0%; wherein a maximum of the range of the ERT is assigned to be 100%.

12. The computer program product of claim 1, wherein the alert originates from a computational device that comprises the non-transitory computer readable storage medium.

13. A computer program product, comprising a non-transitory computer readable storage medium having instructions encoded thereon that, when executed by a processor, cause the processor to erform operations comprising:

receiving operational data of a climate control system of a controlled climate;

computing an actual run time percentage (ART) of the climate control system from the operational data;

receiving temperature data of an uncontrolled climate;

computing an estimated run time percentage (ERT) of the climate control system from the temperature data;

issuing an alert if the ART deviates from the ERT or a range thereof, wherein the alert is to notify an individual about a problem of the climate control system to facilitate repair of the climate control system before the climate control system fails; and creating or updating a data structure comprising a calibration table which comprises:

a first column comprising a plurality of degree day (DD) sum values;

a second column comprising a plurality of ART values; and a third column comprising a plurality of update number values;

wherein if an ART value of the second column is updated, an update number value of the third column is incremented.

14. The computer program product of claim 13, wherein the operations further comprise:

computing an error value by subtracting the ERT from the ART; and computing an adjusted error value by multiplying the error value by an adaptive gain value.

15. The computer program product of claim 14, wherein the adaptive gain value is within a range defined by 0.25 to 0.9, inclusive.

16. The computer program product of claim 14, wherein the operations further comprise:

computing a first new ART value to replace a first old ART value; and computing a second new ART value to replace a second old ART value.

17. The computer program product of claim 16, wherein the first new ART value is computed by subtracting a first computed value from the first old ART value; and wherein the second new ART value is computed by subtracting a second computed value from the second old ART value.

18. The computer program product of claim 17, wherein the first computed value is computed by multiplying a first ratio value by the adjusted error value;

wherein the second computed value is computed by multiplying a second ratio value by the adjusted error value.

19. The computer program product of claim 18, wherein the operations further comprise:

computing an input DD sum value, representative of demand for heating or cooling during a previous observation period;

comparing the input DD sum value to the plurality of DD sum values of the calibration table;

identifying a first DD sum value of the plurality as being less than the input DD sum value, wherein the first DD sum value corresponds to the first old ART value and a first update number value of the plurality of update number values;

identifying a second DD sum value of the plurality as being greater than the input DD sum value, wherein the second DD sum value corresponds to the second old ART value and a second update number value of the plurality of update number values.

20. The computer program product of claim 19, wherein the first ratio value is computed by:

subtracting the input DD sum value from the second DD sum value to produce a first numerator value;

subtracting the first DD sum value from the second DD sum value to produce a first denominator value; and dividing the first numerator value by the first denominator value; and wherein the second ratio value is computed by:

subtracting the first DD sum value from the input DD sum value to produce a second numerator value;

subtracting the first DD sum value from the second DD sum value to produce a second denominator value; and dividing the second numerator value by the second denominator value.

* * * * *